US008102336B2

(12) United States Patent
Uchino et al.

(10) Patent No.: US 8,102,336 B2
(45) Date of Patent: Jan. 24, 2012

(54) DISPLAY APPARATUS AND METHOD FOR MAKING THE SAME

(75) Inventors: Katsuhide Uchino, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 984 days.

(21) Appl. No.: 12/077,090

(22) Filed: Mar. 15, 2008

(65) Prior Publication Data

US 2008/0238836 A1 Oct. 2, 2008

(30) Foreign Application Priority Data

Mar. 26, 2007 (JP) ..... P2007-078221

(51) Int. Cl.
*G09G 3/10* (2006.01)

(52) U.S. Cl. ..... 345/76; 345/55; 345/82; 345/204; 313/463; 315/169.3

(58) Field of Classification Search ..... 345/45, 345/76, 44, 55, 77, 83, 204–206; 313/463, 313/506, 483, 494, 503, 505; 315/169.3, 315/169.1

See application file for complete search history.

(56) References Cited

U.S. PATENT DOCUMENTS

| | | | | |
|---|---|---|---|---|
| 6,281,634 | B1 * | 8/2001 | Yokoyama | 315/169.3 |
| 6,958,802 | B2 * | 10/2005 | Watamura | 349/192 |
| 7,102,202 | B2 * | 9/2006 | Kobayashi et al. | 257/401 |

FOREIGN PATENT DOCUMENTS

| | | |
|---|---|---|
| JP | 2003-255856 | 9/2003 |
| JP | 2003-271095 | 9/2003 |
| JP | 2004-029791 | 1/2004 |
| JP | 2004-093682 | 3/2004 |
| JP | 2004-1334240 | 4/2004 |
| JP | 2005-166687 | 6/2005 |

* cited by examiner

*Primary Examiner* — Lun-Yi Lao
*Assistant Examiner* — Olga Merkoulova
(74) *Attorney, Agent, or Firm* — Robert J. Depke

(57) ABSTRACT

A pixel has an outer region extending linearly along a boundary with an adjacent pixel and an inner region extending along the inner side of the outer region. Wiring lines are arranged across the outer region and the inner region. An outer uneven zone is formed along the outer region and on a substrate due to level differences resulting from the presence of the wiring lines. Similarly, an inner uneven zone is formed along the inner region and on the substrate due to level differences resulting from the presence of the wiring lines. A pattern of a conductor film of which the wiring lines are made is formed properly such that recessed portions of the outer uneven zone are located directly behind their corresponding raised portions of the inner uneven zone, as viewed from inside the pixel.

5 Claims, 18 Drawing Sheets

(1)

(2) , (3)

(4)

(5)

(6)

(7)

DISPLAY APPARATUS AND METHOD FOR MAKING THE SAME

CROSS REFERENCES TO RELATED APPLICATIONS

The present invention contains subject matter related to Japanese Patent Application JP 2007-078221 filed in the Japanese Patent Office on Mar. 26, 2007, the entire contents of which are incorporated herein by reference.

BACKGROUND OF THE INVENTION

1. Field of the Invention

The present invention relates to an active matrix display apparatus having pixels each including a light-emitting device, and to a method for making the active matrix display apparatus.

2. Description of the Related Art

In recent years, increasing efforts have been made to develop flat self-emission display apparatuses in which organic electroluminescent (EL) devices are used as light-emitting devices. An organic EL device is a device using a phenomenon in which an organic thin film emits light when an electric field is applied thereto. The organic EL device, which is driven by the application of a voltage of 10 V or less, is a low power consumption device. At the same time, since the organic EL device, which is a self-emission device capable of emitting light by itself, requires no illuminating unit, it is easy to produce an organic EL device that is thin and lightweight. Additionally, since the response speed of the organic EL device is as very high as several microseconds (μs), it is possible to prevent an afterimage from appearing when a moving image is displayed.

Of flat self-emission display apparatuses with pixels each including an organic EL device, active matrix display apparatuses in which thin-film transistors (TFTs) are formed as drive devices in each pixel in an integrated manner have been particularly actively developed. For example, flat self-emission display apparatuses of active matrix type are described in the following documents: Japanese Unexamined Patent Application Publications Nos. 2003-255856, 2003-271095, 2004-133240, 2004-029791, 2004-093682, and 2005-166687.

An active matrix display apparatus of related art includes a substrate having wiring lines including signal lines arranged in columns, scanning lines arranged in rows, and predetermined power supply lines; and a matrix of pixels, each pixel being disposed at an intersection between a signal line and a scanning line. The wiring lines are formed by patterning a conductor film. Each pixel includes active devices (for example, TFTs) and a light-emitting device (for example, an organic EL device) which are connected to the wiring lines. The pixel operates in response to a control signal supplied from a scanning line. According to a video signal supplied from a signal line, the pixel causes a drive current supplied from a power supply line to flow through the light-emitting device.

SUMMARY OF THE INVENTION

In an active matrix display apparatus of related art, a light-emitting device and TFTs for driving the light-emitting device are formed in each pixel. On a substrate where such pixels are formed in a matrix form in an integrated manner, wiring lines including signal lines, scanning lines, and power supply lines are formed such that they extend longitudinally or transversely across the individual pixels. Since many wiring lines are formed on the substrate, unevenness occurs on the surface of the substrate. The unevenness is caused by level differences in a conductor film, such as a metal film, of which the wiring lines are made. The unevenness corresponding to the wiring lines occurs along the boundaries of adjacent pixels.

The light-emitting device formed in each pixel is, for example, an organic EL device having a laminated structure in which a film of organic EL light-emitting material is interposed between an anode and a cathode. For color display, it is necessary to form films of organic EL light-emitting materials that emit light of different colors (for example, RGB three primary colors) on different pixels, for example, by a thermal transfer process. In the thermal transfer process, pixels formed on a pixel array substrate in an integrated manner are individually surrounded by partition walls. Then, a donor substrate is placed on top of the partition walls. On the donor substrate, films of light-emitting material for one of the three primary colors RGB are formed at positions corresponding to respective pixels on the pixel array substrate. By heating the donor substrate placed opposite the pixel array substrate, with the partition walls interposed therebetween, the films of light-emitting material are evaporated from the donor substrate and transferred onto the corresponding pixels on the pixel array substrate. By performing this process for each of the three primary colors RGB, films of organic EL light-emitting materials that emit light of different colors can be deposited onto different pixels on the pixel array substrate.

Here, it is important to prevent mixture of evaporated materials among pixels to which different colors are assigned. If light-emitting materials for different colors are mixed together within a single pixel, so-called color mixture occurs. As a result, it becomes difficult to produce a color image having excellent sharpness and color reproducibility. In the active matrix display apparatus of the related art described above, the presence of wiring lines results in occurrence of unevenness along the boundaries of pixels. Therefore, even when partition walls are provided along the uneven portions, unevenness still appears on top of the partition walls. Then, this causes a gap to be created when a donor substrate is brought into contact with the uneven portions on top of the partition walls. Even if a light-emitting material to be transferred to the corresponding pixel is surrounded by partition walls, the light-emitting material evaporated through the gap leaks to adjacent pixels and causes color mixture.

In view of the technical disadvantages of the related art described above, it is desirable to provide a display apparatus having an improved wiring pattern for preventing color mixture, and a method for making the display apparatus.

According to an embodiment of the present invention, there is provided a display apparatus including a substrate having wiring lines including at least signal lines arranged in columns, scanning lines arranged in rows, and predetermined power supply lines; and a matrix of pixels, each pixel being disposed at an intersection between a signal line and a scanning line. The wiring lines are formed by patterning a conductor film. Each pixel includes active devices and a light-emitting device connected to the wiring lines, operates in response to a control signal supplied from a scanning line, and causes a drive current supplied from a power supply line to flow through the light-emitting device according to a video signal supplied from a signal line. The pixel has an outer region extending linearly along a boundary with an adjacent pixel and an inner region extending along the inner side of the outer region. The wiring lines are arranged across the outer region and the inner region. An outer uneven zone is formed along the outer region and on the substrate due to level differences resulting from the presence of the wiring lines, and an inner uneven zone is formed along the inner region and on the substrate also due to level differences resulting from the presence of the wiring lines. A pattern of the conductor film of which the wiring lines are made is formed properly such that recessed portions of the outer uneven zone are located directly behind their corresponding raised portions of the inner uneven zone, as viewed from inside the pixel.

Preferably, the conductor film includes an upper layer and a lower layer; the wiring lines include upper layer lines formed by patterning the upper layer and lower layer lines formed by patterning the lower layer; and a pattern of the lower layer is formed properly such that the recessed portions of the outer uneven zone are located directly behind their corresponding raised portions of the inner uneven zone, as viewed from inside the pixel. The pattern of the conductor film may be electrically connected to the wiring lines and constitute part of the wiring lines. The pattern of the conductor film may include pads that are electrically isolated from the wiring lines and compensate for level differences resulting from the presence of the wiring lines.

According to an embodiment of the present invention, there is also provided a method for making a display apparatus including a substrate having wiring lines including at least signal lines arranged in columns, scanning lines arranged in rows, and predetermined power supply lines; and a matrix of pixels, each pixel being disposed at an intersection between a signal line and a scanning line; wherein the wiring lines are formed by patterning a conductor film; and each pixel includes active devices and a light-emitting device connected to the wiring lines, operates in response to a control signal supplied from a scanning line, and causes a drive current supplied from a power supply line to flow through the light-emitting device according to a video signal supplied from a signal line. The method for making the display apparatus includes the steps of arranging the wiring lines across an outer region and an inner region of the pixel, the outer region extending linearly along a boundary with an adjacent pixel, the inner region extending along the inner side of the outer region; forming properly a pattern of the conductor film of which the wiring lines are made such that recessed portions of an outer uneven zone are located directly behind their corresponding raised portions of an inner uneven zone as viewed from inside the pixel, the outer uneven zone being formed along the outer region and on the substrate due to level differences resulting from the presence of the wiring lines, the inner uneven zone being formed along the inner region and on the substrate also due to level differences resulting from the presence of the wiring lines; forming, along the outer uneven zone and the inner uneven zone, partition walls surrounding the inside area of the pixel; preparing a working base on which films of light-emitting materials that emit light of different colors are deposited at positions corresponding to the respective pixels; placing the working base opposite the substrate, with the working base being in contact with the top of the partition walls; and evaporating the films of light-emitting materials that emit light of different colors onto the respective inside areas of the corresponding pixels, with the inside area of each pixel being surrounded by the partition walls, so as to form a light-emitting layer of the light-emitting device in each pixel.

According to an embodiment of the present invention, an outer region and an inner region are arranged linearly along the boundary between adjacent pixels. In other words, each pixel is doubly surrounded by the inner region and the outer region. Since the outer region and the inner region are defined along the boundary between adjacent pixels, many wiring lines are arranged on the substrate such that they extend across these regions. The wiring lines are formed by patterning a conductor film, such as a metal film. Due to level differences resulting from the presence of the wiring lines, unevenness occurs on the surface of the substrate. In particular, since such unevenness occurs along the boundary between adjacent pixels, an outer uneven zone is formed along the outer region and an inner uneven zone is formed along the inner region. In a structure of related art, where there is no distinction between the inner and outer regions, an uneven zone has a simple structure. Therefore, even if partition walls are provided on top of the uneven zone, the pattern of the uneven zone appears directly.

On the other hand, in the embodiment of the present invention, a pattern of the conductor film of which the wiring lines are made is formed properly such that recessed portions of the outer uneven zone are located directly behind their corresponding raised portions of the inner uneven zone, as viewed from inside the pixel. Therefore, even if particles traveling in straight lines pass through the recessed portions of the outer uneven zone, they are blocked by the corresponding raised portions of the inner uneven zone and prevented from entering the pixel. Thus, in the thermal transfer process, even when organic EL materials that emit light of different colors are heated and evaporated onto different pixels, color mixture among the pixels can be prevented. That is, it is possible to realize a display panel having excellent color reproducibility.

DESCRIPTION OF THE PREFERRED EMBODIMENTS

Figure 1:
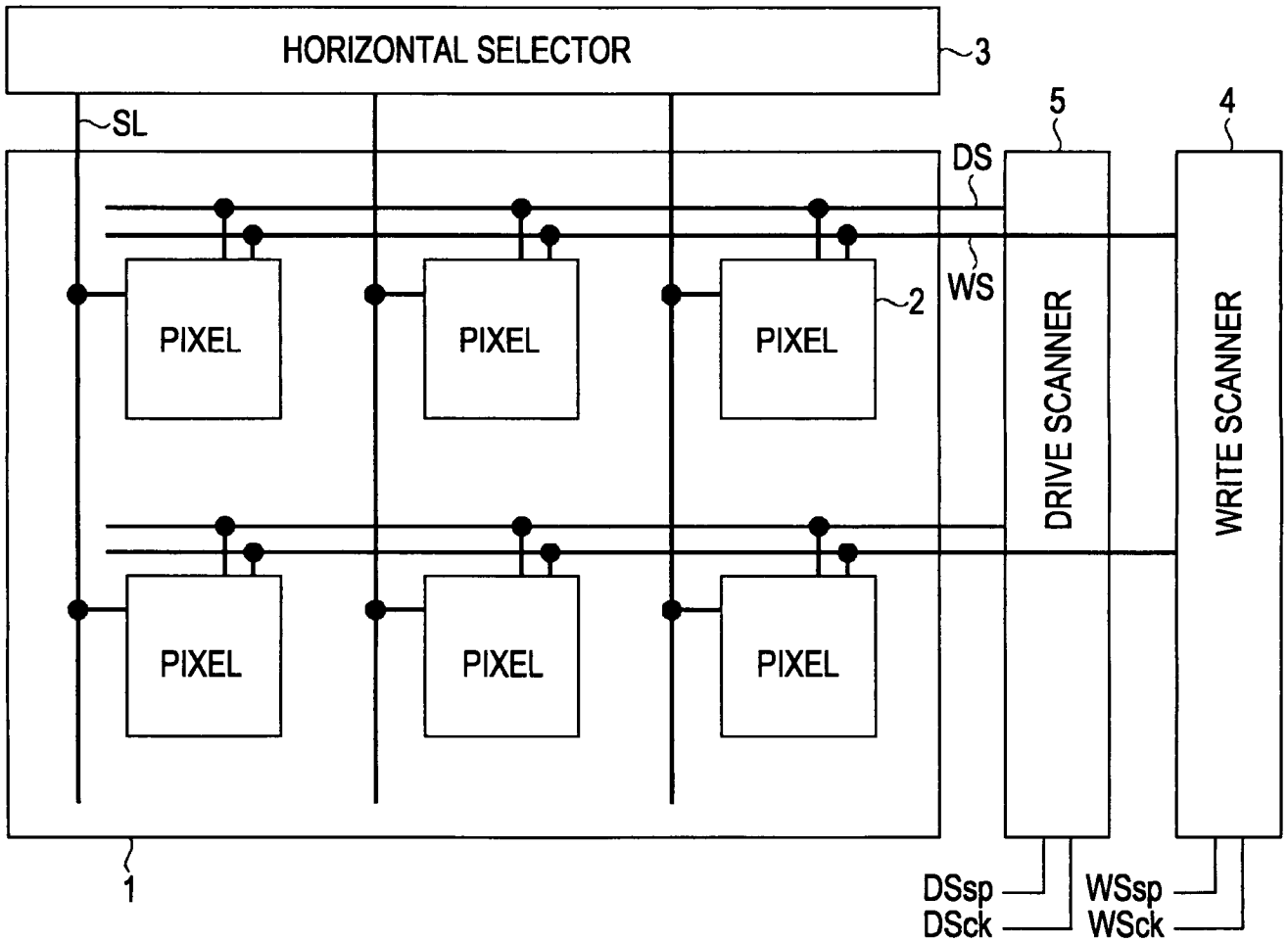
FIG. 1 is a block diagram illustrating an overall configuration of a display apparatus according to an embodiment of the present invention.

Embodiments of the present invention will now be described in detail with reference to the drawings. FIG. 1 is a block diagram illustrating an overall configuration of a display apparatus according to an embodiment of the present invention. As illustrated, the display apparatus includes a pixel array unit (pixel array substrate) 1 and a driver (3, 4, and 5) for driving the pixel array unit 1. The pixel array unit 1 includes scanning lines WS arranged in rows, signal lines SL arranged in columns, a matrix of pixels 2 each being disposed at an intersection between a scanning line WS and a signal line SL, and power supply lines DS each corresponding to a row of pixels 2. The driver includes a control scanner (write scanner) 4 for successively supplying control signals to the scanning lines WS to perform line-sequential scanning on the pixels 2 on a row-by-row basis, a power supply scanner (drive scanner) 5 for supplying a power supply voltage switching between a first potential and a second potential to the power supply lines DS in synchronization with the line-sequential scanning described above, and a signal selector (horizontal selector) 3 for supplying a signal potential serving as a video signal and a reference potential to the signal lines SL in synchronization with the line-sequential scanning described above. The write scanner 4 operates in response to a clock signal WSck externally supplied thereto. By successively transmitting a start pulse WSsp also externally supplied thereto, the write scanner 4 outputs a control signal to each scanning line WS. The drive scanner 5 operates in response to a clock signal DSck externally supplied thereto. By successively transmitting a start pulse DSsp also externally supplied thereto, the drive scanner 5 line-sequentially switching the potentials of the power supply lines DS.

Figure 2:
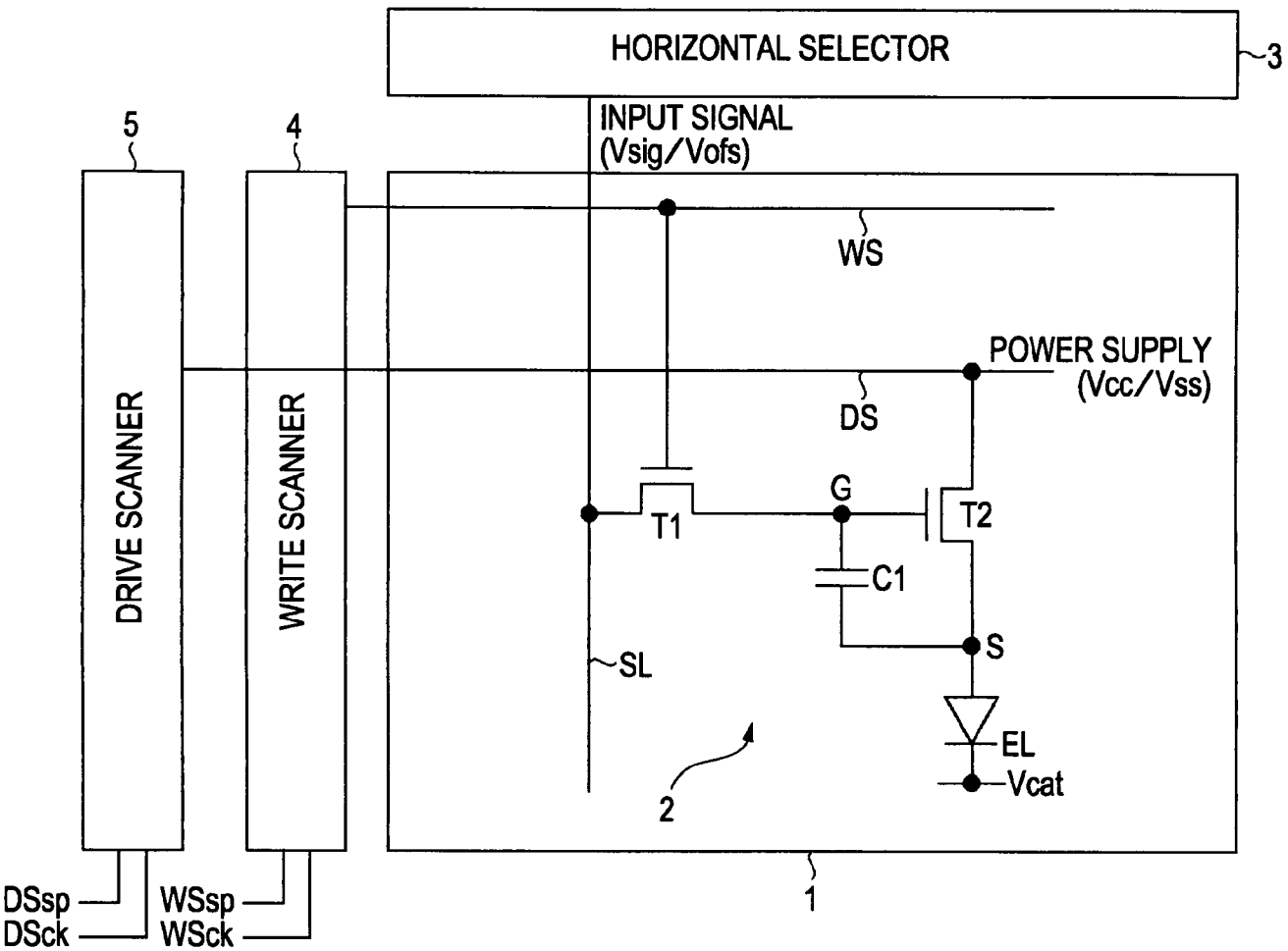
FIG. 2 is a circuit diagram illustrating a configuration of a pixel in the display apparatus of FIG. 1.

FIG. 2 is a circuit diagram illustrating a configuration of a pixel 2 included in the display apparatus of FIG. 1. As illustrated, the pixel 2 includes a two-terminal (diode-type) light-emitting device EL typified by an organic EL device, an N-channel sampling transistor T1 (active device), an N-channel drive transistor T2 (active device), and a thin-film hold capacitor C1. The gate of the sampling transistor T1 is connected to a scanning line WS, either one of the source and drain of the sampling transistor T1 is connected to a signal line SL, and the other of the source and drain of the sampling transistor T1 is connected to a gate G of the drive transistor T2. Either one of the source and drain of the drive transistor T2 is connected to the light-emitting device EL, and the other of the source and drain of the drive transistor T2 is connected to a power supply line DS. In the present embodiment, the drain of the drive transistor T2, which is an N-channel transistor, is connected to the power supply line DS and a source S of the drive transistor T2 is connected to the anode of the light-emitting device EL. The cathode of the light-emitting device EL is held at a predetermined cathode potential Vcat. The hold capacitor C1 is placed between the source S and gate G of the drive transistor T2. To the pixels 2 each having the configuration of FIG. 2, the write scanner 4 successively outputs control signals by switching the scanning lines WS between a high potential and a low potential so as to perform line-sequential scanning on the pixels 2 on a row-by-row basis. The drive scanner 5 supplies a power supply voltage switching between a first potential Vcc and a second potential Vss to each power supply line DS in synchronization the line-sequential scanning described above. Also in synchronization the line-sequential scanning described above, the horizontal selector 3 supplies a signal potential Vsig serving as a video signal and a reference potential Vofs to the signal lines SL in columns.

In the configuration described above, the sampling transistor T1 is brought into conduction in response to a control signal supplied from the scanning line WS, samples the signal potential Vsig supplied from the signal line SL, and stores the sampled signal potential Vsig in the hold capacitor C1. The drive transistor T2 receives a current from the power supply line DS at the first potential Vcc, and causes a drive current to flow through the light-emitting device EL according to the signal potential Vsig stored in the hold capacitor C1. To keep the sampling transistor T1 in conduction during the time period in which the signal line SL is at the signal potential Vsig, the write scanner 4 outputs a control signal of a predetermined duration to the scanning line WS, and thus performs a correction for a mobility μ of the drive transistor T2 on the signal potential Vsig while storing the signal potential Vsig in the hold capacitor C1.

Figure 3:
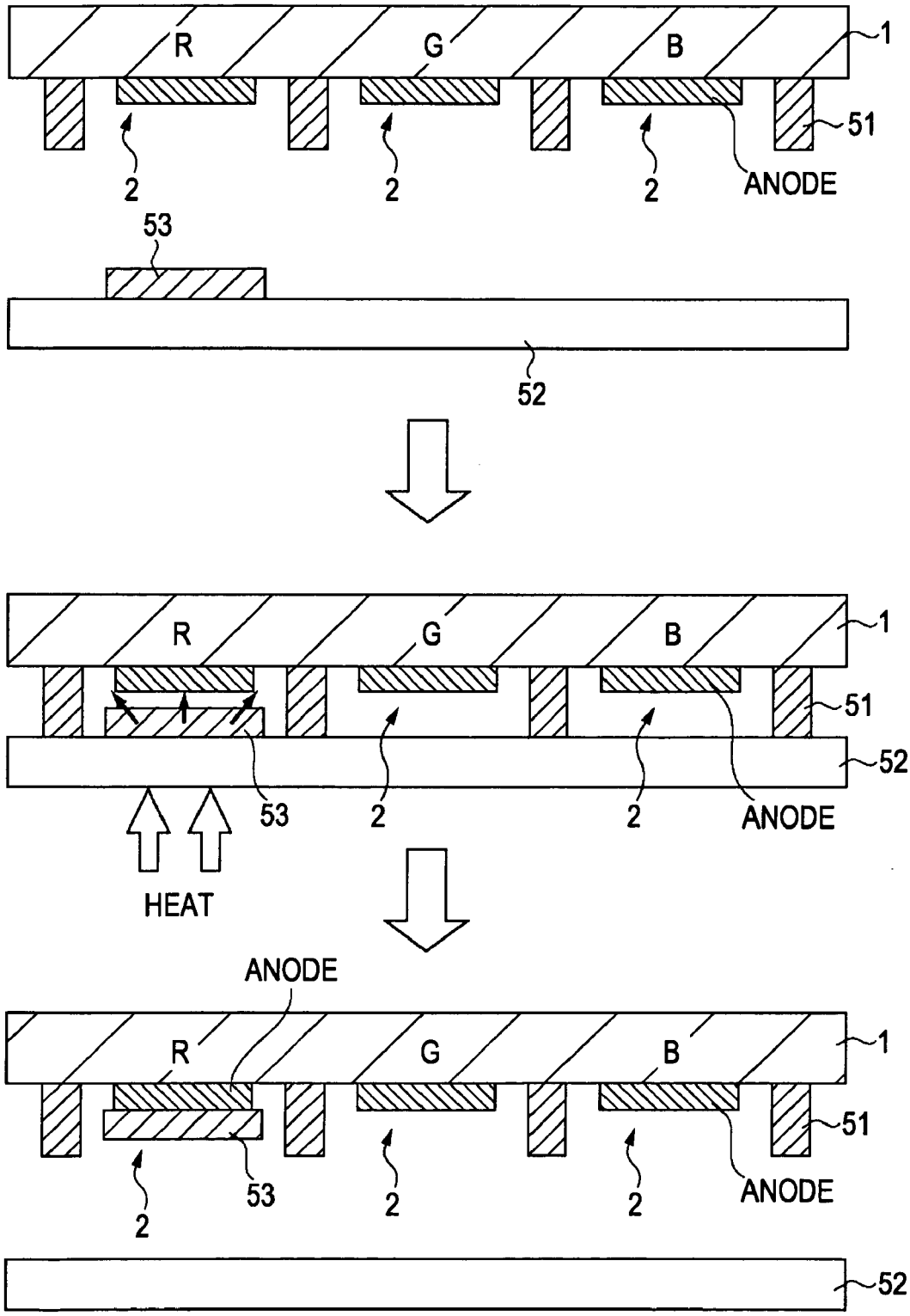
FIG. 3 is a schematic diagram illustrating a method for making the display apparatus of FIG. 1.

FIG. 3 is a schematic diagram illustrating a process of forming the light-emitting device EL of FIG. 2. In this example, a light-emitting layer of the light-emitting device EL is formed by a thermal transfer process. As illustrated, first, the pixel array substrate 1 is prepared. In a semiconductor manufacturing process prior to this process, active devices, such as TFTs, and a thin-film capacitance device are formed in each pixel 2 on the pixel array substrate 1 in an integrated manner. An electrode serving as an anode is also formed in each pixel 2. Each pixel 2 is assigned one of the three primary colors RGB for color display. Each pixel 2 is surrounded by partition walls 51 formed along the boundaries between adjacent pixels 2.

Besides the pixel array substrate 1 described above, a donor substrate (working base) 52 is prepared. On a surface of the donor substrate 52, a film of light-emitting material 53 for red (R) color is deposited at a position corresponding to an R pixel.

Thus, the donor substrate 52 provided with the film of the light-emitting material 53 for red color is placed opposite the pixel array substrate 1 provided with the anodes, with the partition walls 51 interposed therebetween. Thus, each pixel 2 is surrounded and enclosed by the partition walls 51, the inner surface of the pixel array substrate 1, and the inner surface of the donor substrate 52. After the pixel 2 is enclosed, the outer surface (rear side) of the donor substrate 52 is heated, and thus, the film of the light-emitting material 53 for red color is evaporated onto the corresponding anode on the pixel array substrate 1. In the thermal transfer process described above, the film of the light-emitting material 53 for red color on the donor substrate 52 can be transferred precisely to the R pixel in the pixel array substrate 1. If the pixel 2 is surrounded and completely enclosed, it is possible to prevent the evaporated light-emitting material 53 from leaking to the adjacent pixels, and hence color mixture can be avoided.

After the film of the light-emitting material 53 for red color is transferred to the anode of the R pixel, the used donor substrate 52 is separated from the pixel array substrate 1. Then, in the next step, another donor substrate on which a film of light-emitting material for green (G) color is deposited is prepared, and the same thermal transfer process as that described above is performed. Thus, the film of the light-emitting material for green color can be transferred to the anode of a G pixel in the pixel array substrate 1. Likewise, by performing the same thermal transfer process as that described above, a film of light-emitting material for blue color can be transferred to the anode of a B pixel in the pixel array substrate 1.

Figure 4:
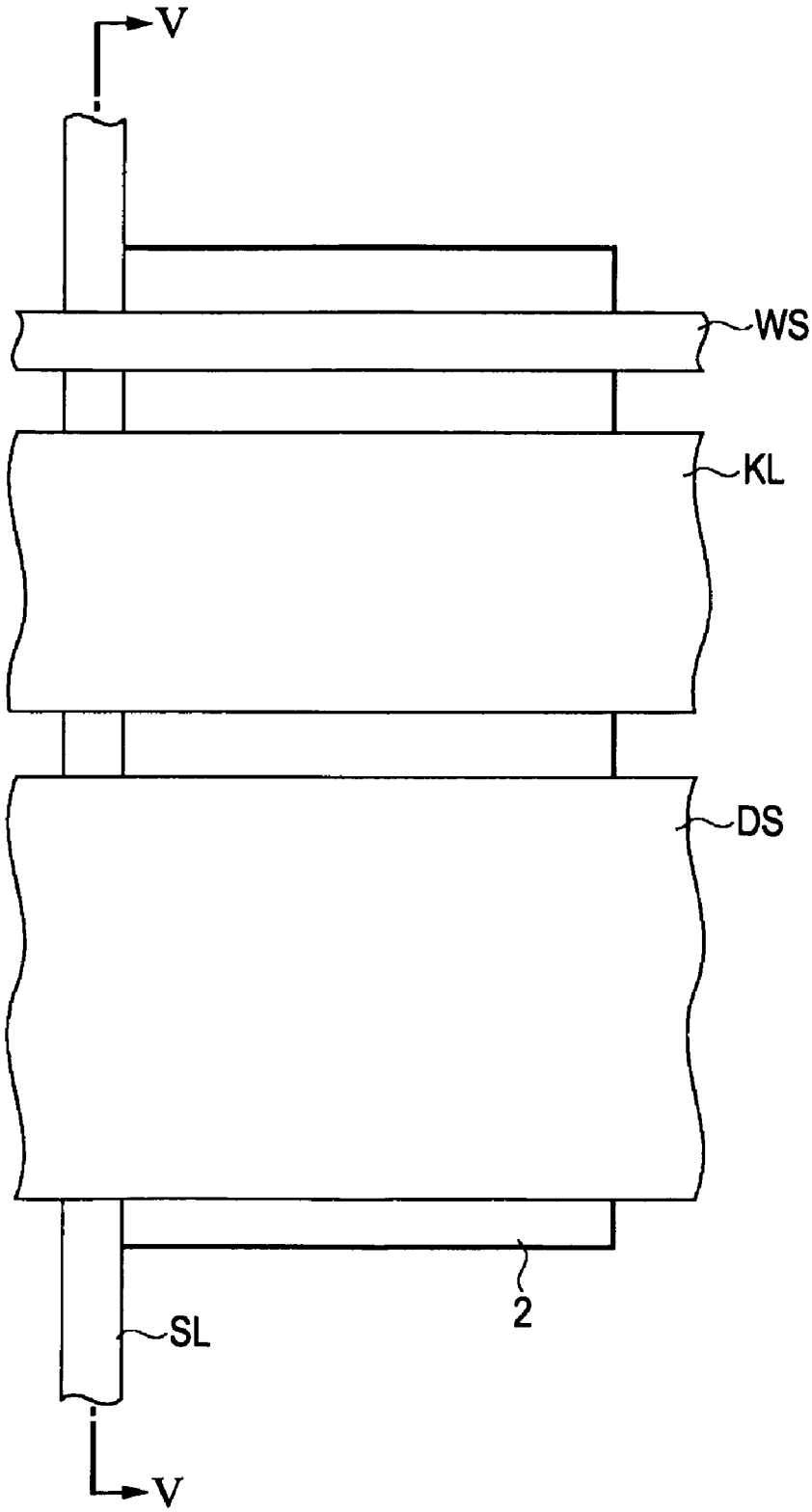
FIG. 4 is a plan view illustrating a reference example of a wiring layout in the pixel of FIG. 2.

FIG. 4 is a schematic plan view illustrating an exemplary layout of the wiring lines formed in the pixel 2. The layout of FIG. 4 is presented for reference purposes and is different from that of an embodiment of the present invention. Referring to FIG. 4, a gate line, a cathode line, and a power supply line extend transversely across the pixel 2. For example, the gate line corresponds to the scanning line WS of FIG. 2 and thus is represented by WS in FIG. 4. The power supply line corresponds to the power supply line DS of FIG. 2 and thus is represented by DS in FIG. 4. The cathode line, which supplies a predetermined cathode voltage to the cathode of the light-emitting device EL of FIG. 2, is represented by KL in FIG. 4. Since the power supply line DS generally supplies a sufficient amount of current to each pixel 2, it is necessary to reduce the resulting electrical resistance, and thus the power supply line DS often has a multilayer wiring structure. Accordingly, the cathode line KL and the gate line WS may have a multilayer wiring structure. At the same time, the signal line SL extends longitudinally across each pixel 2. The signal line SL is arranged along the boundary with the adjacent pixel, and located under the gate line WS, cathode line KL, and power supply line DS extending transversely across each pixel 2. If the gate line WS, cathode line KL, and power supply line DS have a double-layer wiring structure including upper and lower conductor layers, the lower conductor layer and the signal line SL may be provided on the same layer.

When the thermal transfer process illustrated in FIG. 3 is used, partition walls surrounding each pixel are formed along the signal lines SL. As illustrated in FIG. 4, since the gate line WS, cathode line KL, and power supply line DS extend across the signal line SL, level differences are made by the presence of these wiring lines having given material thicknesses, and as a result, an uneven zone is produced along the signal line SL.

Figure 5:
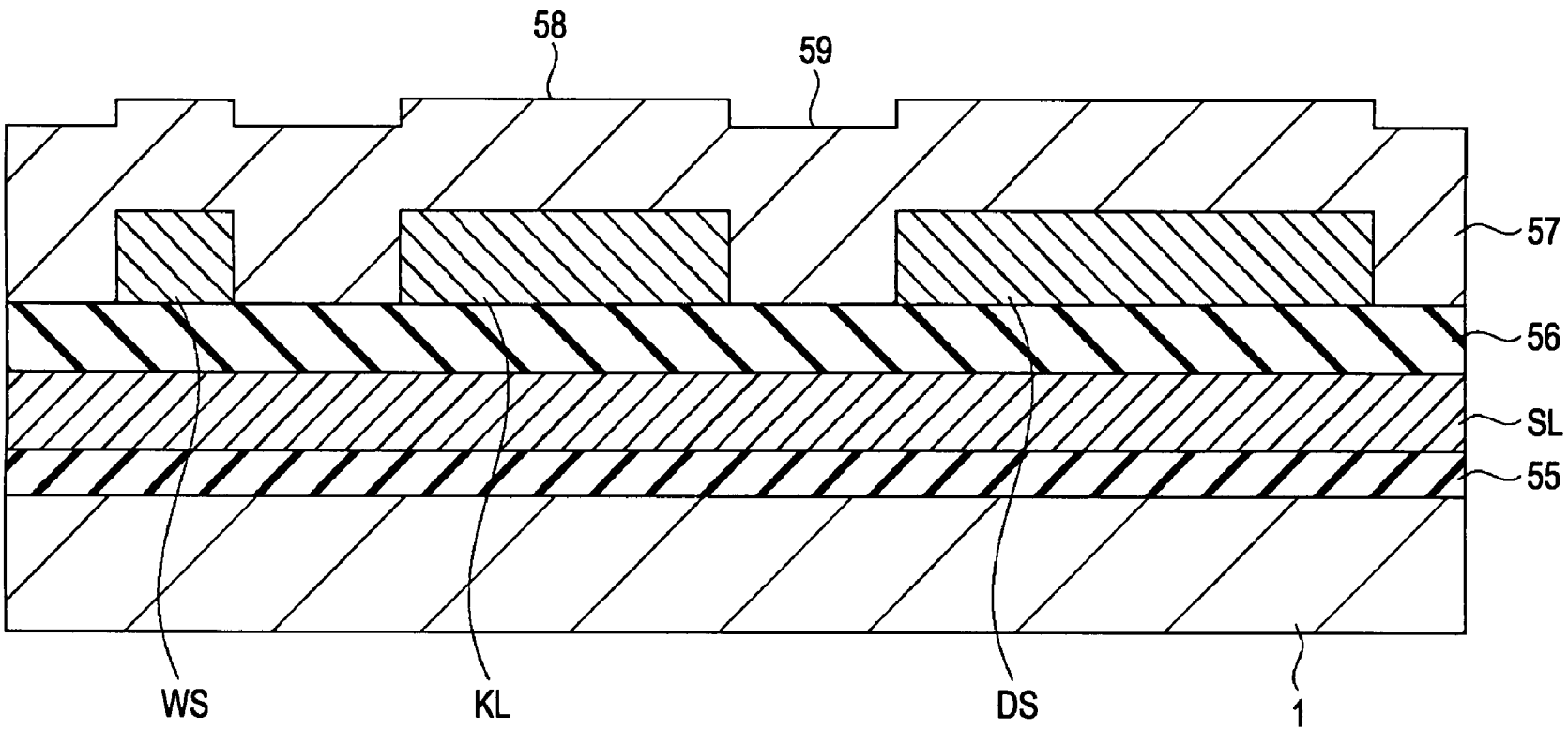
FIG. 5 is a cross-sectional view of the wiring layout of FIG. 4.

FIG. 5 is a cross-sectional view taken along line V in FIG. 4. As illustrated in FIG. 5, the signal line SL is formed on the pixel array substrate 1 with an insulator 55 interposed therebetween. The gate line WS, cathode line KL, and power supply line DS are formed on an interlayer insulator 56 disposed on the signal line SL, and are laid out such that they extend across the signal line SL. These lines WS, KL, and DS are covered with a planarizing film 57. Since it is difficult to ensure a sufficient thickness of the planarizing film 57, the level differences caused by the presence of the lines WS, KL, and DS are not sufficiently compensated for by providing the planarizing film 57. Therefore, raised portions 58 and recessed portions 59 are formed on the surface of the planarizing film 57 along the signal line SL. A series of the raised portions 58 and recessed portions 59 forms an uneven zone along the signal line SL. As can be seen from FIG. 5, the raised portions 58 appear above the corresponding lines WS, KL, and DS, while the recessed portions 59 appear above the corresponding spaces between adjacent ones of the lines WS, KL, and DS. Consequently, although the pixel array substrate 1 is covered with the planarizing film 57, uneven zones formed by series of raised portions 58 and recessed portions 59 are observed along the boundaries of pixels.

In the thermal transfer process, partition walls are formed along the uneven zones, and then, a donor substrate is brought into contact with the top of the partition walls. However, the level differences of the raised portions 58 and recessed portions 59 are not necessarily completely compensated for by providing the partition walls. Therefore, uneven zones corresponding to the raised portions 58 and recessed portions 59 are also produced on top of the partition walls. As a result, when the donor substrate is placed on top of the partition walls, small gaps are created at positions corresponding to the recessed portions 59. This causes leakage of light-emitting materials for different colors through the gaps, and thus causes color mixture.

Figure 6:
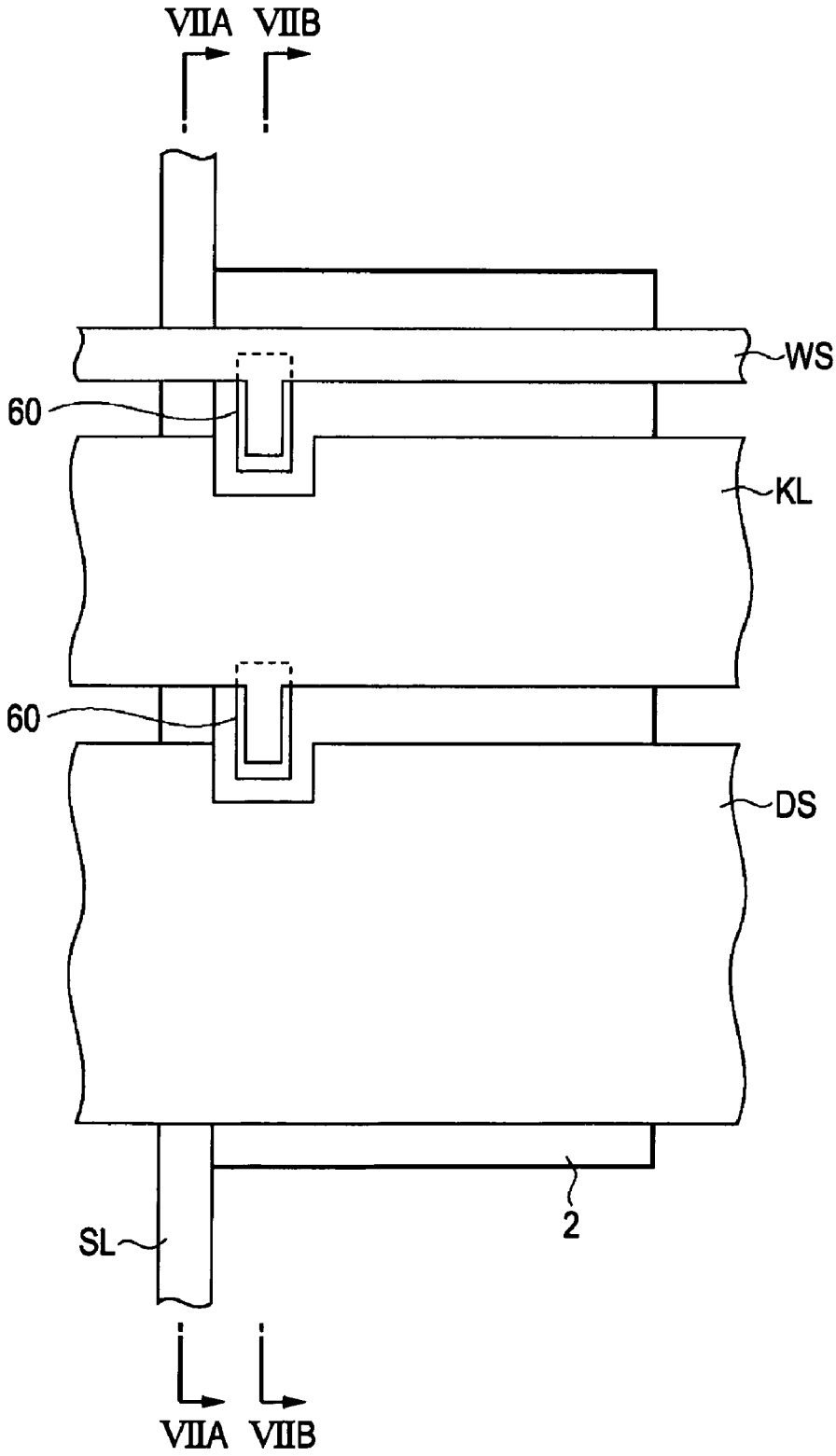
FIG. 6 is a plan view illustrating an exemplary wiring layout according to an embodiment of the present invention.

FIG. 6 is a schematic plan view illustrating the wiring lines laid out according to an embodiment of the present invention. For ease of understanding, components corresponding to those in the reference example of FIG. 4 are given reference numeral and characters identical to those in FIG. 4. As in the case of the reference example of FIG. 4, the gate line WS, the cathode line KL, and the power supply line DS are arranged in stripes such that they extend transversely across each pixel 2. On the other hand, the signal line SL is formed such that it extends longitudinally across each pixel 2.

The pixel 2 has an outer region and an inner region. The outer region linearly extends along the boundary with the adjacent pixel, while the inner region extends along the inner side of the outer region. In FIG. 6, the outer region is defined by line VIIA and the inner region is defined by line VIIB. Line VIIA is along the signal line SL. Therefore, the outer region is a region along the signal line SL, which is originally formed along the boundary between adjacent pixels. The inner region (B) and outer region (A) are parallel to each other and doubly surround the pixel 2.

Level differences caused by the presence of the gate line WS, cathode line KL, and power supply line DS appear along the outer region (A) and thus, an uneven zone is produced. Likewise, level differences caused by the presence of the gate line WS, cathode line KL, and power supply line DS appear along the inner region (B) and thus, an uneven zone in formed. In the present embodiment, where an improvement is made to the wiring pattern of FIG. 4, pads 60 are provided along the inner region (B). Although the pads 60 are formed on the same conductor layer as that of the signal line SL, the pads 60 are electrically isolated from the signal line SL. As illustrated, the gate line WS and cathode line KL partially extend over the corresponding pads 60.

Figure 7A:
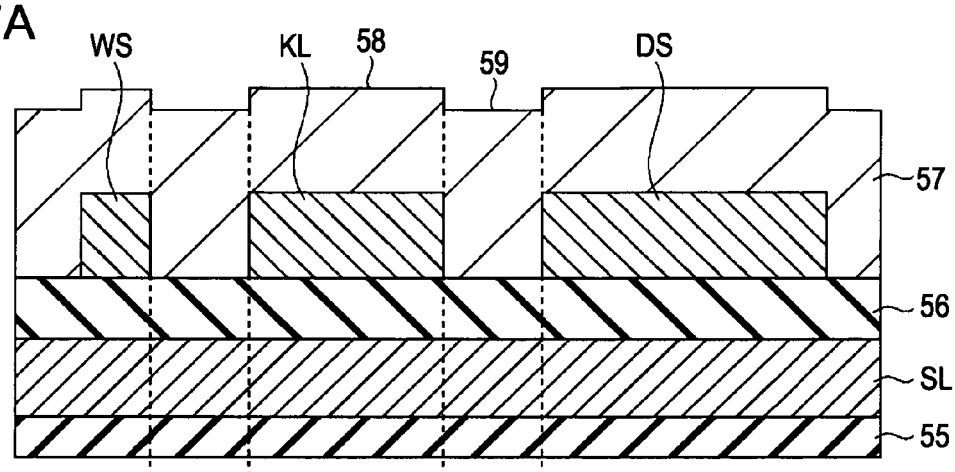
FIG. 7A and FIG. 7B are cross-sectional views of the wiring layout of FIG. 6.
Figure 7B:
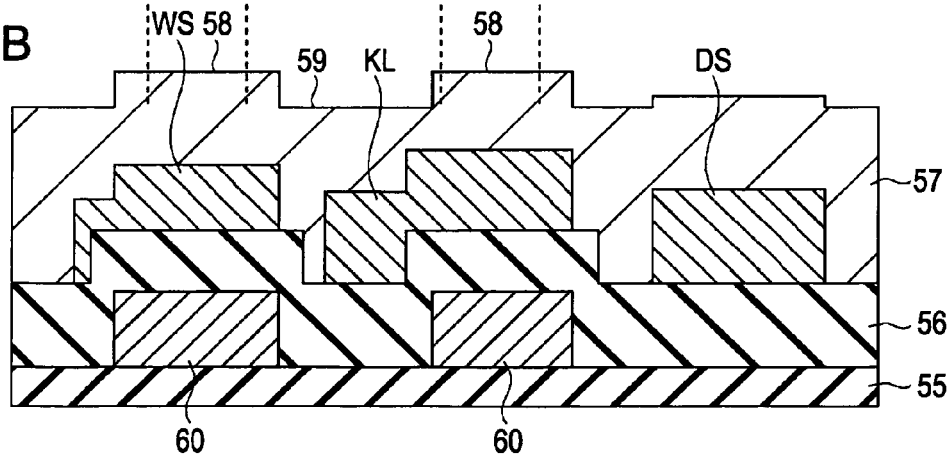

FIG. 7A and FIG. 7B are cross-sectional views taken along lines VIIA and VIIB, respectively, in FIG. 6. FIG. 7A illustrates a cross section of the outer uneven zone along the outer region (A), and FIG. 7B illustrates a cross section of the inner uneven zone along the inner region (B).

In the outer region (A), an uneven zone on the surface of the planarizing film 57 is formed by a series of the raised portions 58 and the recessed portions 59 corresponding to the presence and absence of the gate line WS, cathode line KL, and power supply line DS.

On the other hand, in the inner region (B), the gate line WS partially extends over the corresponding pad 60 formed on the same layer as that of the signal line SL, and thus, one raised portion 58 is formed at the position corresponding to this pad 60. Similarly, since the cathode line KL partially extends over the corresponding pad 60, another raised portion 58 is formed at the position corresponding to this pad 60. The recessed portion 59 is created between these raised portions 58.

As can be seen from the uneven zones in the outer region (A) and inner region (B), a pattern (including the pads 60 and the extending parts of the gate line WS and cathode line KL) of the conductor film of which the gate line WS, cathode line KL, and power supply line DS are made is formed properly such that the recessed portions 59 of the uneven zone in the outer region (A) are located directly behind the corresponding raised portions 58 of the uneven zone in the inner region (B), as viewed from inside the pixel. With this structure, as viewed from inside the pixel, the recessed portions 59 located outside are hidden behind the corresponding raised portions 58 located inside. If the illustrated uneven pattern directly appears on top of the partition walls, a light-emitting material for a wrong color may enter the pixel through the outer recessed portions 59 in the thermal transfer process. However, even particles of such light-emitting material traveling through the outer recessed portions 59 are blocked by the corresponding inner raised portions 58, the particles do not penetrate further into the pixel. Therefore, it is possible to prevent the situation where light-emitting material to be evaporated onto an adjacent pixel erroneously penetrates deeper into the pixel. Thus, color mixture can be effectively prevented.

As can be seen from the description above, according to the present embodiment, the pads 60 are provided on the same layer as the signal line SL and beside recessed parts of the layer of the power supply line DS. Additionally, the gate line WS and the like are laid out over the pads 60. Thus, the raised portions 58 are formed on the surface of the planarizing film 57. Then, by adding partition walls to the surface of the planarizing film 57, it is made possible to prevent mixture of light-emitting materials that emit light of different colors, and thus to realize a display panel having excellent color reproducibility. Additionally, according to the present embodiment, if the cathode line KL and gate line WS as well as the power supply line DS have a multilayer wiring structure, it is possible to increase the aperture ratio and reduce the density of current flowing through the light-emitting device, such as an organic EL device, for light emission. As a result, it is made possible to provide a long-life display panel. Moreover, if the cathode line KL and the multilayered power supply line DS are arranged in the same layer, it is possible to reduce wiring costs. According to the present embodiment, if the cathode wiring is multilayered, it is possible to suppress an increase in the voltage of the cathode that is most distant from the cathode input terminal, and thus to achieve uniform image quality.

Figure 8A:
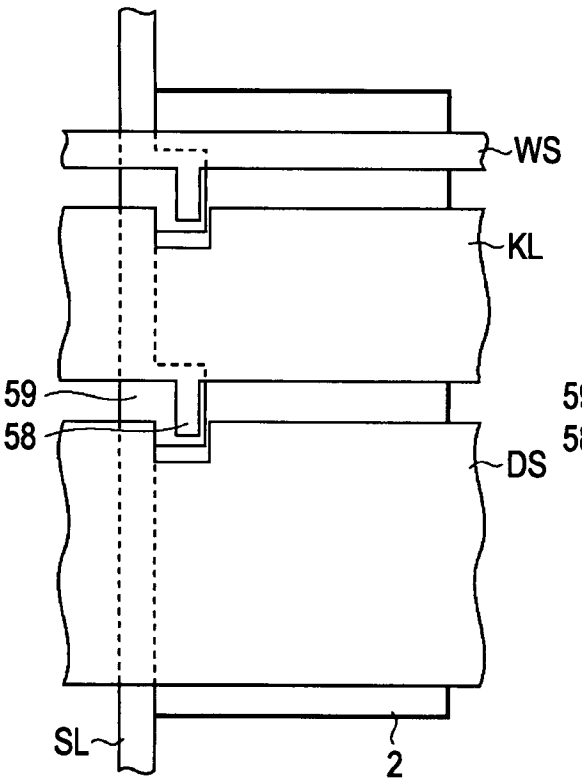
FIG. 8A to FIG. 8C are plan views illustrating exemplary wiring layouts obtained by modifying the wiring layout of FIG. 6.
Figure 8B:
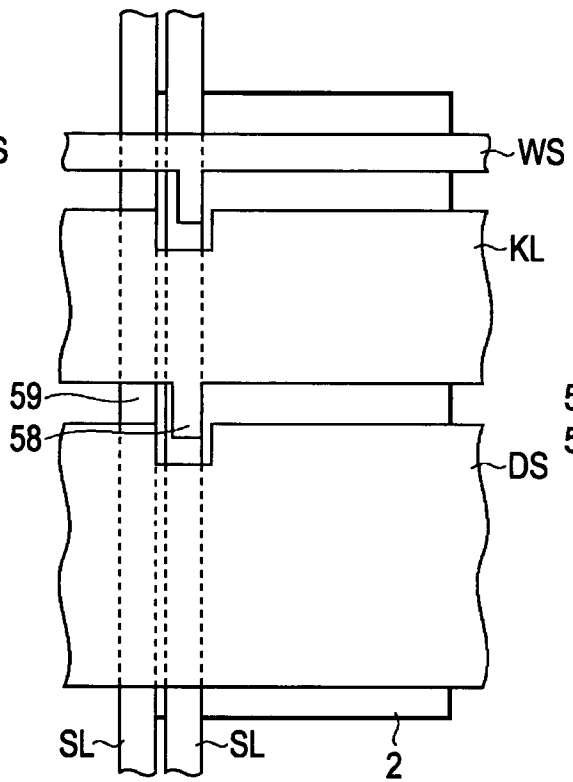
Figure 8C:
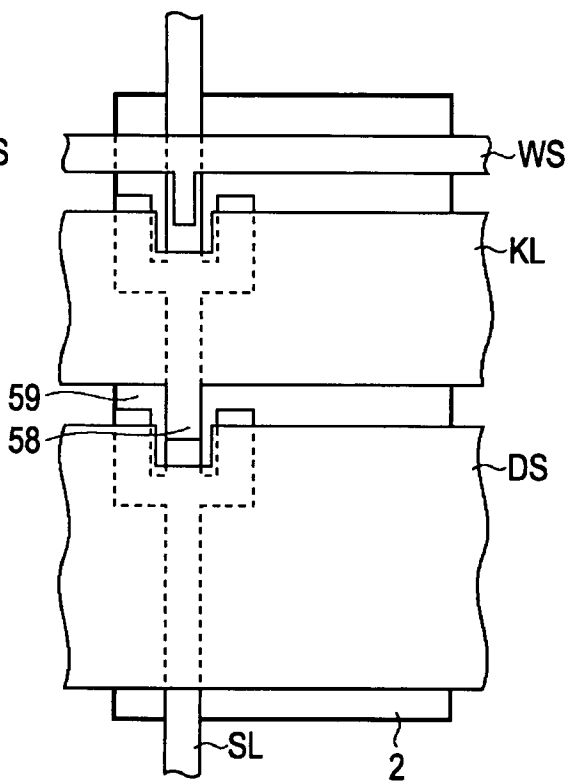

FIG. 8A to FIG. 8C are schematic plan views illustrating exemplary pattern layouts obtained by modifying the pattern layout of FIG. 6.

FIG. 8A illustrates a modified pattern layout in which pads and the signal line SL are combined together, that is, the pads constitute part of the signal line SL. At the same time, extending parts of the gate line WS and cathode line KL are provided over the pads. Thus, the outer recessed portion 59 and the inner raised portion 58 overlap each other, as viewed from inside the pixel 2.

FIG. 8B illustrates a modified pattern layout in which an additional signal line SL, instead of pads, is provided. Thus, by forming the signal lines SL in both the outer and inner regions, the electrical resistance of the signal lines can be reduced. In the modified pattern layout of FIG. 8B, the outer signal line SL corresponds to the outer region and the inner signal line SL corresponds to the inner region. Extending parts of both the gate line WS and the cathode line KL are provided over the signal line SL in the inner region. Thus, the recessed portion 59 in the outer region and the raised portion 58 in the inner region overlap each other, as viewed from inside the pixel 2.

FIG. 8C illustrates a modified pattern layout in which pads are arranged on both sides of the signal line SL. This means that the pixel 2 is surrounded by three layers. This three-layer structure makes it possible to prevent color mixture more reliably than in the case of the two-layer structure. With a four-layer structure or a five-layer structure, it is possible to more reliably prevent color mixture.

Figure 9:
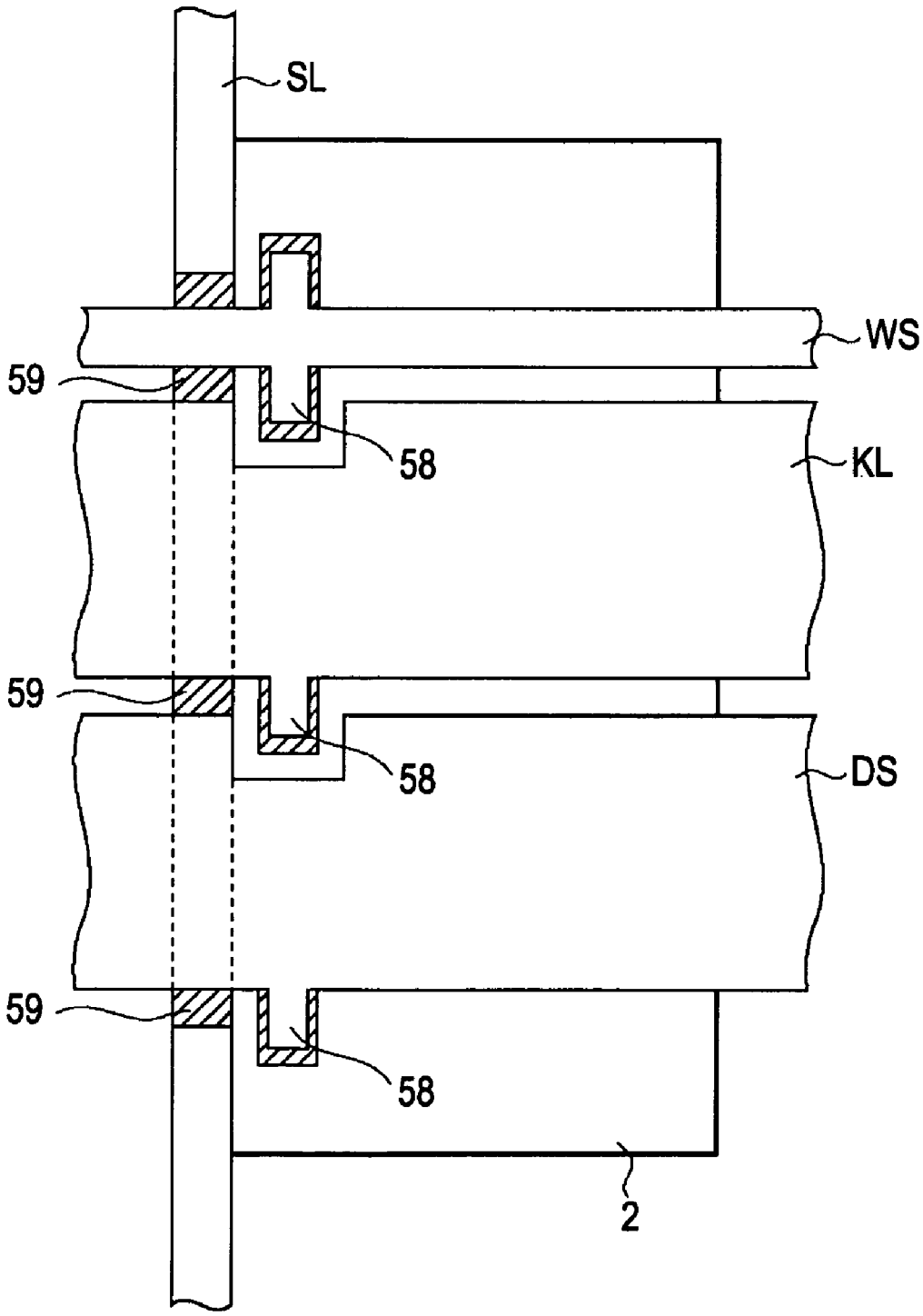
FIG. 9 is a plan view illustrating another exemplary wiring layout obtained by modifying the wiring layout of FIG. 6.

FIG. 9 is a plan view illustrating another exemplary pattern layout obtained by modifying the pattern layout of FIG. 6. In the pattern layout of FIG. 9, the signal line SL in the longitudinal direction and the gate line WS, cathode line KL, and power supply line DS in the transverse direction are formed of a metal film on the same layer, and thus do not have a multilayer wiring structure. Again, with a proper layout of the wiring lines, it is possible to make the recessed portions 59 in the outer region and the corresponding raised portions 58 in the inner region overlap each other, as viewed from inside the pixel 2. In the exemplary pattern layout of FIG. 9, the signal line SL has a laminated structure including an upper metal film (for example, an aluminum film) and a lower polysilicon film under the upper metal film. The lower polysilicon film is, for example, on the same layer as the device region for TFTs, and the thickness of the lower polysilicon film is negligibly smaller than that of the upper metal (aluminum) film. As described above, when the power supply line layer in the transverse direction and the signal line layer in the longitudinal direction are on the same layer, the pattern layout is made such that level differences can be compensated for. Therefore, it is possible to prevent mixture of light-emitting materials that emit light of different colors.

Figure 10:
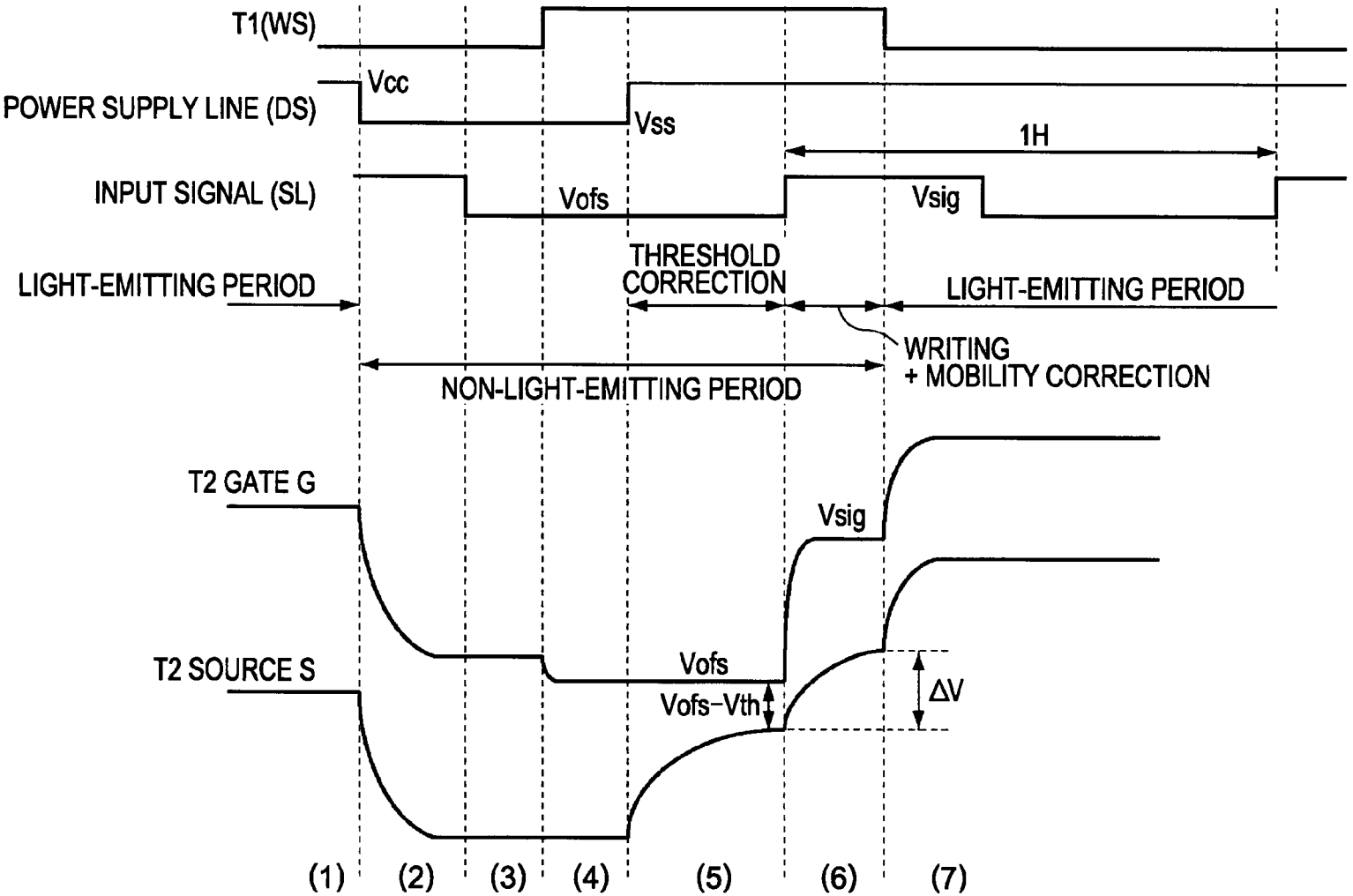
FIG. 10 is a timing chart for explaining the operation of the pixel of FIG. 2.

FIG. 10 is a timing chart for explaining the operation of the pixel of FIG. 2. This timing chart is presented for illustrative purposes only. The control sequence of the pixel circuit of FIG. 2 is not limited to that shown by the timing chart of FIG. 10. The timing chart shows, along the same time axis, changes in the potential of the scanning line WS, power supply line DS, and signal line SL. The changes in the potential of the scanning line WS represent changes in the level of control signal for on/off control of the sampling transistor T1. The changes in the potential of the power supply line DS represent switching between the power supply voltages Vcc and Vss. The changes in the potential of the signal line SL represent switching between the signal potential Vsig of an input signal and the reference potential Vofs. In parallel with these changes in potential, the timing chart shows changes in the potential of the gate G and source S of the drive transistor T2. The difference in potential between the gate G and the source S is represented by Vgs.

In the timing chart of FIG. 10, for illustrative purposes, the entire period is divided into (1) to (7) according to the transition of the operation in the pixel. In a period (1) immediately before a new field for line-sequential scanning starts, the light-emitting device EL is in a light-emitting state. Then, the new field starts. At the beginning of the first period (2), the potential of the power supply line DS is changed from the first potential Vcc to the second potential Vss. At the beginning of the next period (3), the potential of the input signal is changed from Vsig to Vofs. At the beginning of the next period (4), the sampling transistor T1 is turned on. During the period from (2) to (4), the gate voltage and source voltage of the drive transistor T2 are reset. The period from (2) to (4) is a preparation period for making preparation necessary for threshold voltage correction. During this preparation period, the gate G of the drive transistor T2 is reset to Vofs, while the source S of the drive transistor T2 is reset to Vss. Next, in a threshold correction period (5), the threshold voltage correction is actually performed, and a voltage equivalent to the threshold voltage Vth is held between the gate G and source S of the drive transistor T2. In practice, the voltage equivalent to the threshold voltage Vth is written to the hold capacitor C1 placed between the gate G and source S of the drive transistor T2. Then, in a writing period/mobility correction period (6), the signal potential Vsig of a video signal is added to the threshold voltage Vth, the resulting voltage is written to the hold capacitor C1, and at the same time, a voltage ΔV for mobility correction is subtracted from the voltage held in the hold capacitor C1. In the writing period/mobility correction period (6), it is necessary to keep the sampling transistor T1 in conduction during the time period in which the signal line SL is at the signal potential Vsig. Then, in a light-emitting period (7), the light-emitting device EL emits light at an intensity depending on the signal potential Vsig. Since the signal potential Vsig is adjusted with the voltage equivalent to the threshold voltage Vth and the voltage ΔV for mobility correction, the intensity of light emitted from the light-emitting device EL is not affected by variations in the threshold voltage Vth and mobility μ of the drive transistor T2. A bootstrap operation is performed at the beginning of the light-emitting period (7). Thus, the gate potential and source potential of the drive transistor T2 increase while the voltage Vgs between the gate G and source S of the drive transistor T2 is kept constant.

The operation of the pixel circuit of FIG. 2 will be further described in detail with reference to FIG. 11 to FIG. 18.

Figure 11:
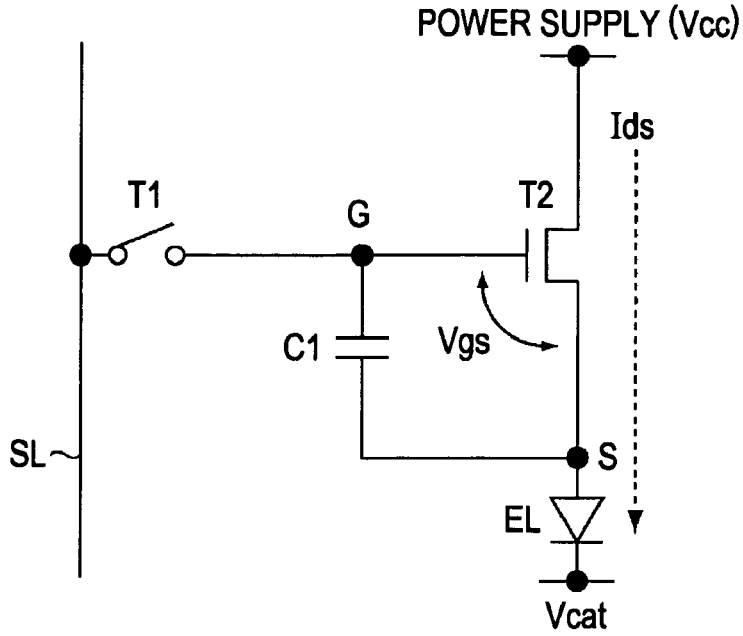
FIG. 11 is a schematic diagram for explaining the operation of the pixel of FIG. 2.

FIG. 11 illustrates a state of the pixel circuit during the light-emitting period (1). As illustrated, in this period, the power supply potential is at Vcc, and the sampling transistor T1 is off. Since the drive transistor T2 is set to operate in a saturated region, a drive current Ids flowing through the light-emitting device EL depends on the voltage Vgs applied across the gate G and source S of the drive transistor T2, and can be expressed by the transistor characteristic equation as follows:

$$Ids=(1/2)\mu(W/L)Cox(Vgs-Vth)^2$$

where μ represents the mobility of the drive transistor, W represents the channel width of the drive transistor, L represents the channel length of the drive transistor, Cox represents the gate insulation capacitance of the drive transistor, and Vth represents the threshold voltage of the drive transistor. As can be seen from the characteristic equation above, when operating in a saturation region, the drive transistor T2 serves as a constant current source that supplies the drain current Ids according to the gate voltage Vgs.

Figure 12:
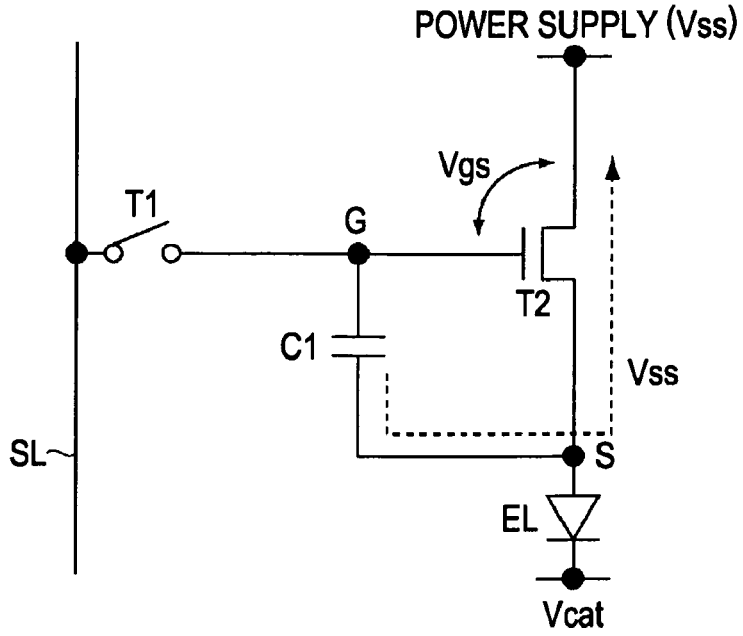
FIG. 12 is another schematic diagram for explaining the operation of the pixel of FIG. 2.

FIG. 12 illustrates a state of the pixel circuit during the preparation period (2) and (3). At the beginning of the period (2), the potential of the power supply line is changed to Vss, as shown in FIG. 12. The value of Vss is set to be smaller than the sum of a threshold voltage Vthel of the light-emitting device EL and the cathode voltage Vcat, that is, Vss<Vthel+Vcat. Therefore, the light-emitting device EL is turned off, and the power supply side is made to serve as the source of the drive transistor T2. At this point, the anode of the light-emitting device EL is charged to Vss.

Figure 13:
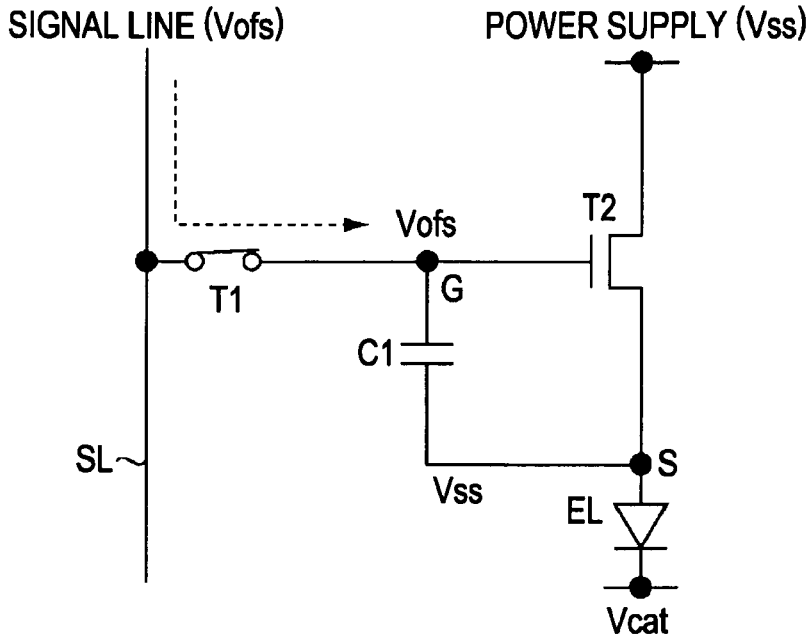
FIG. 13 is another schematic diagram for explaining the operation of the pixel of FIG. 2.

FIG. 13 illustrates a state of the pixel circuit during the preparation period (4). During this period, the potential of the signal line SL is kept at Vofs, the sampling transistor T1 is turned on, and the gate potential of the drive transistor T2 is lowered to Vofs. Thus, the source S and gate G of the drive transistor T2 are reset. At this point, the gate voltage Vgs is made equivalent to the value of Vofs−Vss (that is, Vgs=Vofs−Vss), which is set to be larger than the threshold voltage Vth of the drive transistor T2. Thus, by resetting the drive transistor T2 such that the condition Vgs>Vth is satisfied, the preparation for the subsequent threshold voltage correction process is completed.

Figure 14:
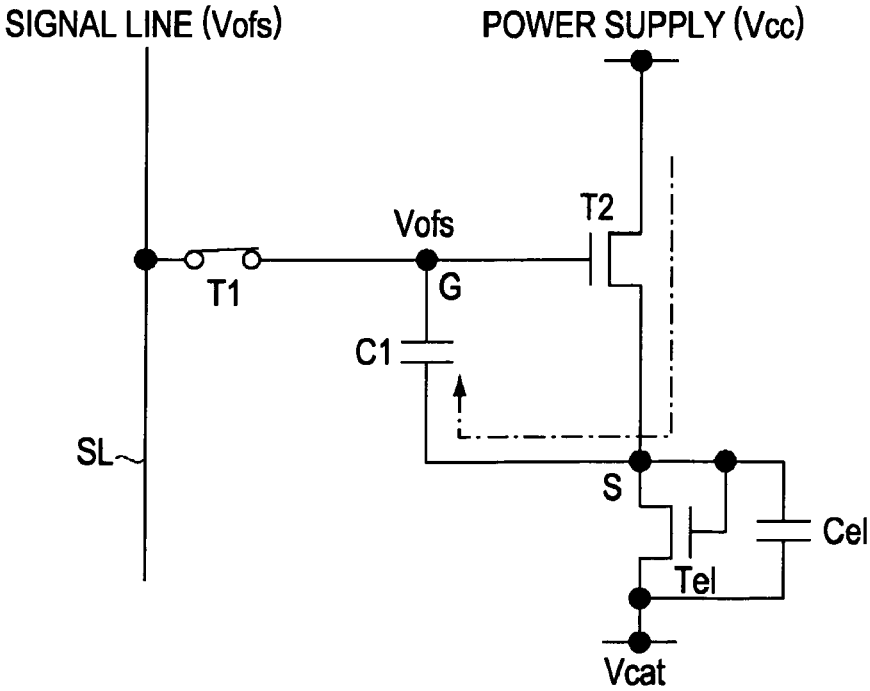
FIG. 14 is another schematic diagram for explaining the operation of the pixel of FIG. 2.

FIG. 14 illustrates a state of the pixel circuit during the threshold voltage correction period (5). At the beginning of this period, the potential of the power supply line DS is returned to Vcc. When the power supply voltage is set to Vcc, the anode of the light-emitting device EL becomes the source S of the drive transistor T2, and the current flows as illustrated in FIG. 14. The equivalent circuit of the light-emitting device EL can be represented by a parallel connection of a diode Tel and a capacitor Cel. Since the anode potential (that is, the source potential Vss) is lower than Vcat+Vth, the diode Tel is in off-state, and the amount of leakage current flowing through the diode Tel is much smaller than the amount of current flowing through the drive transistor T2. Therefore, the current flowing through the drive transistor T2 is used mostly for charging the hold capacitor C1 and an equivalent capacitor Cel.

Figure 15:
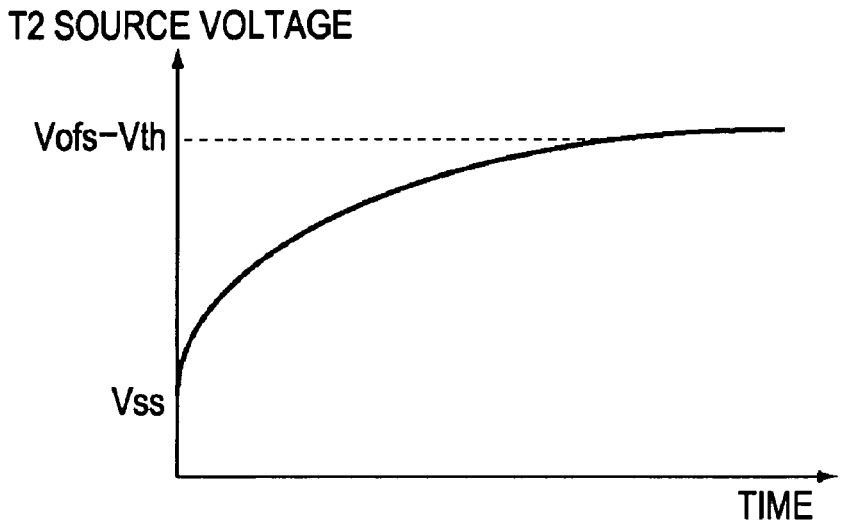
FIG. 15 is a graph for explaining the operation of the pixel of FIG. 2.

FIG. 15 is a graph showing a change in the source voltage of the drive transistor T2 with time during the threshold voltage correction period (5). As shown, from Vss, the source voltage of the drive transistor T2 (that is, the anode voltage of the light-emitting device EL) increases with time. Upon completion of the threshold voltage correction period (5), the drive transistor T2 is cut off, and the voltage Vgs between the gate G and source S of the drive transistor T2 becomes Vth. The source potential is given by Vofs−Vth. Since the value of Vofs−Vth is still lower than Vcat+Vthel, the light-emitting device EL is still in off-state.

Figure 16:
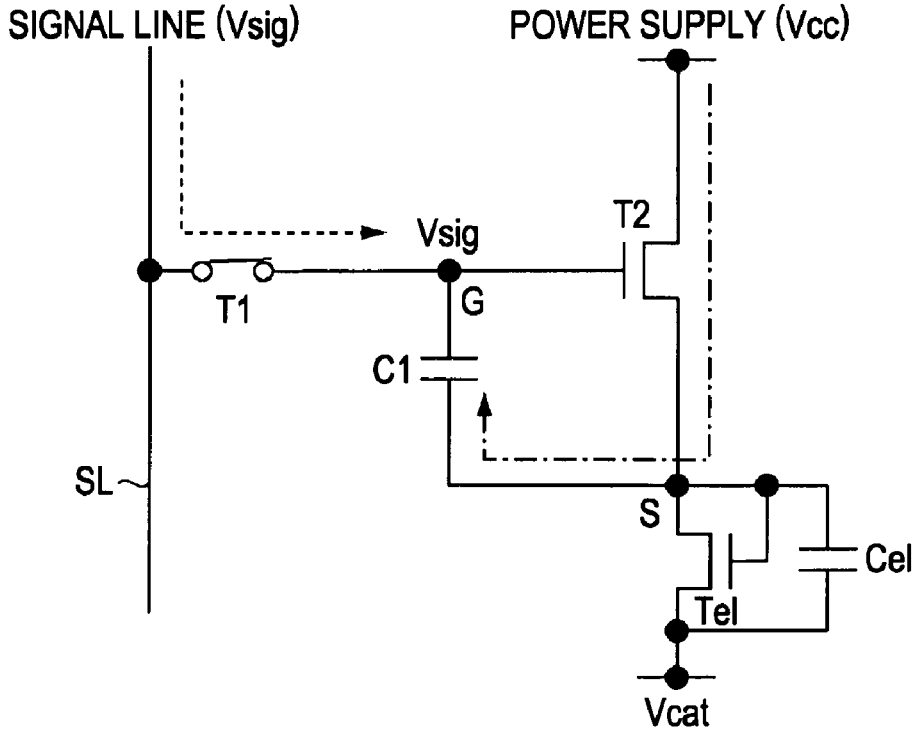
FIG. 16 is another schematic diagram for explaining the operation of the pixel of FIG. 2.

FIG. 16 illustrates a state of the pixel circuit during the writing period/mobility correction period (6). At the beginning of the writing period/mobility correction period (6), the potential of the signal line SL is changed from Vofs to Vsig while the sampling transistor T1 is kept on. At this point, the signal potential Vsig is at a voltage corresponding to the gray-scale level. Since the sampling transistor T1 is in on-state, the gate potential of the drive transistor T2 is raised to Vsig. At the same time, since a current flows from the power supply Vcc, the source potential of the drive transistor T2 increases with time. At this point, the source potential of the drive transistor T2 still does not exceed the sum of the threshold voltage Vthel and cathode potential Vcat of the light-emitting device EL. Therefore, the current flowing from the drive transistor T2 is used mostly for charging the hold capacitor C1 and the equivalent capacitor Cel. Since the threshold voltage correction operation of the drive transistor T2 is already completed at this point, the amount of current passing through the drive transistor T2 reflects the mobility μ. More specifically, if the drive transistor T2 has a high mobility μ, the amount of current passing through the drive transistor T2 and an increase in source potential ΔV are large. Conversely, if the drive transistor T2 has a low mobility μ, the amount of current passing through the drive transistor T2 and an increase in source potential ΔV are small. With the operation described above, the gate voltage Vgs of the drive transistor T2 reflects the mobility μ thereof and is reduced by ΔV. Thus, upon completion of the writing period/mobility correction period (6), the gate voltage Vgs reflecting the completely corrected mobility μ can be obtained.

Figure 17:
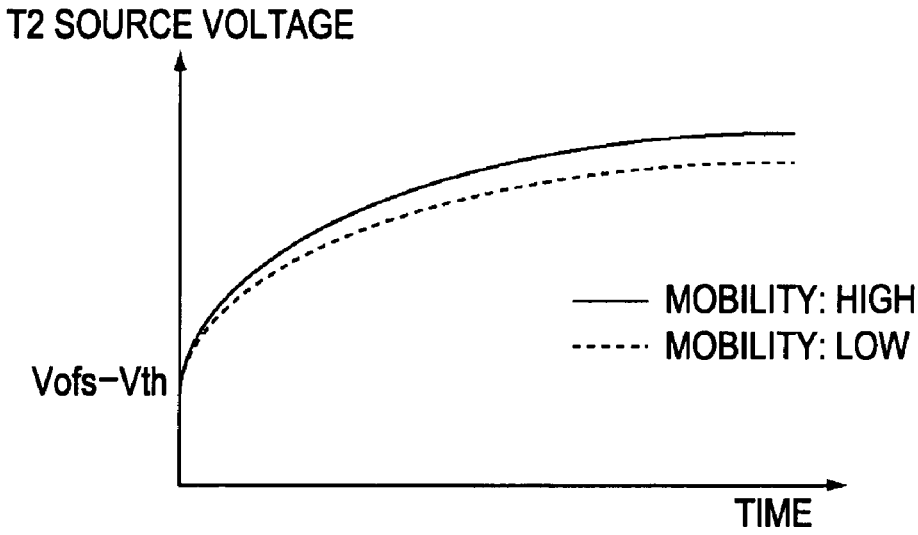
FIG. 17 is another graph for explaining the operation of the pixel of FIG. 2.

FIG. 17 is a graph showing a change in the source voltage of the drive transistor T2 with time during the writing period/mobility correction period (6). As shown, when the mobility μ of the drive transistor T2 is high, the source voltage thereof increases rapidly, and the voltage Vgs is reduced accordingly. In other words, when the mobility μ is high, the voltage Vgs is reduced to cancel the effect of the mobility μ, and thus the drive current can be suppressed. Conversely, when the mobility μ of the drive transistor T2 is low, since the source voltage thereof does not increase very rapidly, the voltage Vgs is not reduced very significantly. In other words, when the mobility μ is low, the voltage Vgs is not significantly reduced so that it is possible to compensate for low driving capability.

Figure 18:
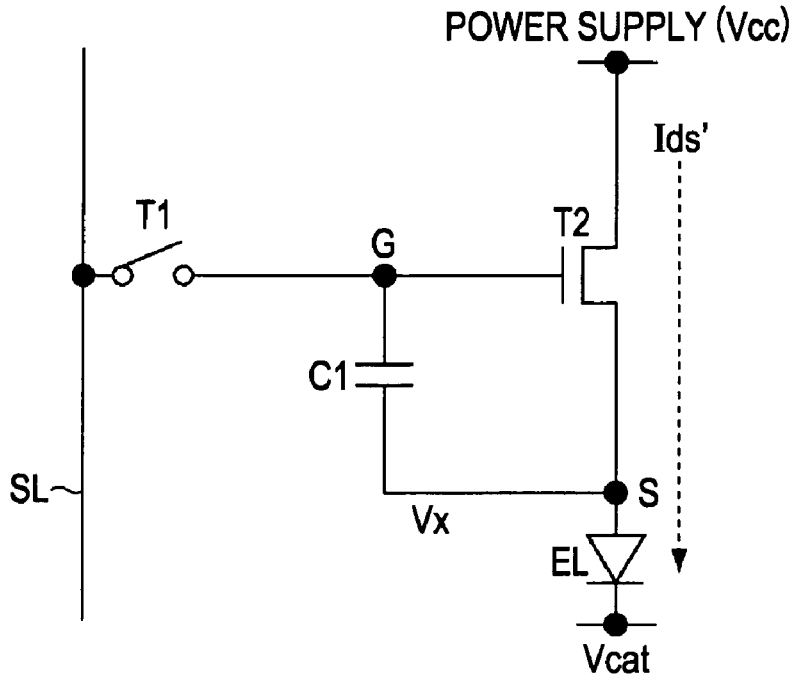
FIG. 18 is another schematic diagram for explaining the operation of the pixel of FIG. 2.

FIG. 18 illustrates a state of the pixel circuit during the light-emitting period (7), where the sampling transistor T1 is turned off and the light-emitting device EL emits light. The gate voltage Vgs of the drive transistor T2 is kept constant, while the drive transistor T2 causes a current Ids' to flow at a constant rate through the light-emitting device EL according to the transistor characteristic equation described above. Since the current Ids' flows through the light-emitting device EL, the anode voltage of the light-emitting device EL (that is, the source voltage of the drive transistor T2) increases to Vx. When Vx exceeds Vcat+Vthel, the light-emitting device EL starts emitting light. As the duration of light emission increases, the current/voltage characteristics of the light-emitting device EL change. Therefore, the potential of the source S illustrated in FIG. 18 changes. However, since the gate voltage Vgs of the drive transistor T2 is kept constant by the bootstrap operation, the current Ids' flowing through the light-emitting device EL remains unchanged. That is, even if the current/voltage characteristics of the light-emitting device EL degrade, the light emission intensity of the light-emitting device EL does not change, because the current Ids' keeps flowing at a constant rate.

Figure 19:
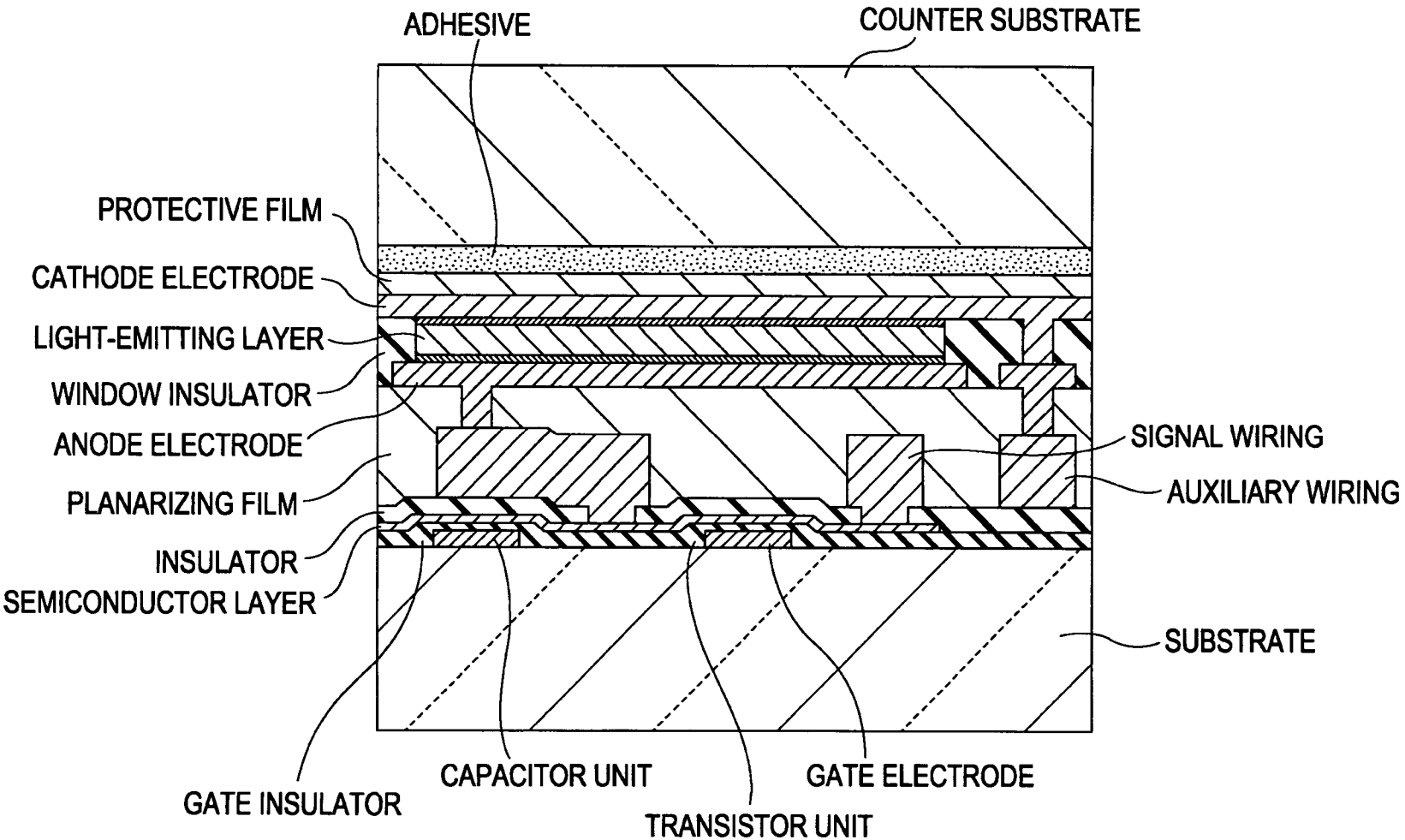
FIG. 19 is a cross-sectional view illustrating a device structure of a display apparatus according to an embodiment of the present invention.

FIG. 19 is a cross-sectional view illustrating a thin-film device structure of the display apparatus according to an embodiment of the present invention. FIG. 19 schematically illustrates a cross section of a pixel formed on an insulating substrate. As illustrated, the pixel includes a transistor unit including a plurality of TFTs (only one TFT is shown in FIG. 19), a capacitor unit such as a hold capacitor, and a light-emitting unit such as an organic EL device. The transistor unit and the capacitor unit are formed by a TFT process on the substrate. The light-emitting unit is formed over the transistor unit and the capacitor unit. Then, a transparent counter substrate is bonded to the light-emitting unit with an adhesive therebetween. Thus, a flat panel is produced.

Figure 20:
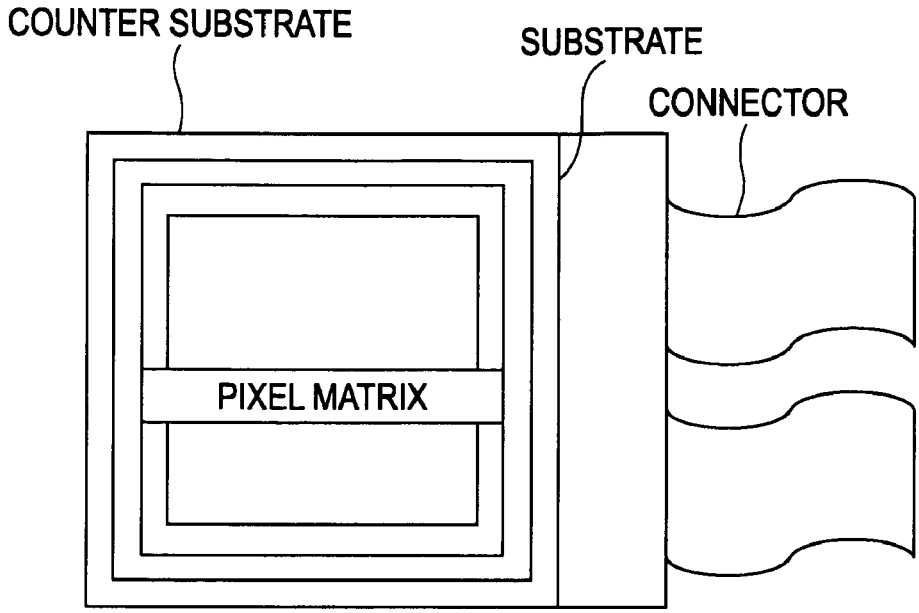
FIG. 20 is a plan view illustrating a module structure of a display apparatus according to an embodiment of the present invention.

As illustrated in FIG. 20, the display apparatus according to an embodiment of the present invention may be a flat display module. For example, the display module includes an insulating substrate on which a pixel array (pixel matrix) is disposed. The pixel array includes a matrix of pixels arranged in an integrated manner. Each pixel includes an organic EL device, TFTs, a thin-film capacitor, and the like. The display module is produced by attaching a transparent counter substrate, such as a glass substrate, to an adhesive surrounding the pixel array (pixel matrix). If necessary, the transparent counter substrate may be provided with a color filter, a protective film, a light-shielding film, and the like. At the same time, the display module may be provided with a connector, such as a flexible printed circuit (FPC), for transmission of signals or the like between the pixel array and external devices.

The display apparatus according to the above-described embodiments of the present invention is a flat panel display that can be included in various types of electronic equipment (for example, digital cameras, notebook personal computers, mobile phones, and video camcorders) capable of displaying externally input or internally generated video signals as an image or video. Hereinafter, examples of such electronic equipment will be described.

Figure 21:
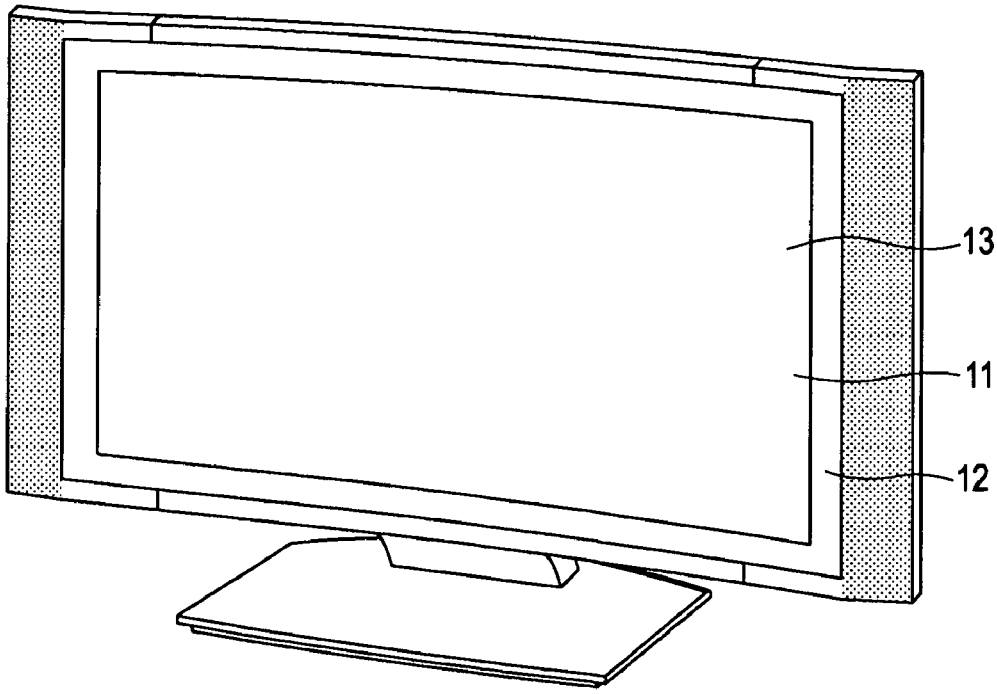
FIG. 21 is a perspective view of a television set including a display apparatus according to an embodiment of the present invention.

FIG. 21 illustrates a television set to which the present invention is applied. The television set includes an image display screen 11 composed of a front panel 12, a glass filter 13, and the like. The television set of FIG. 14 is realized by using a display apparatus according to an embodiment of the present invention as the image display screen 11.

Figure 22:
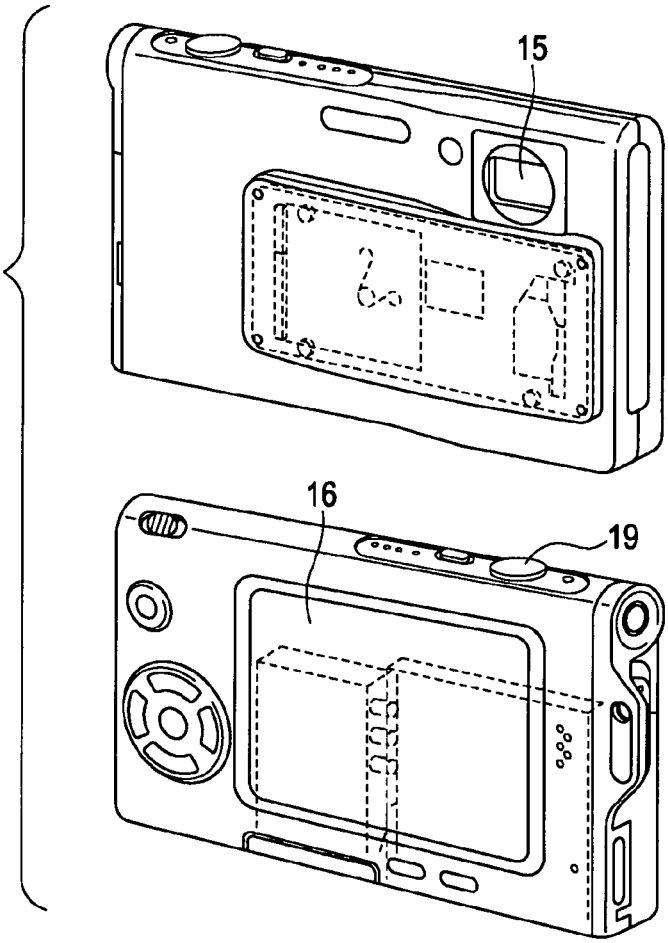
FIG. 22 is a perspective view of a digital still camera including a display apparatus according to an embodiment of the present invention.

FIG. 22 illustrates a digital camera to which the present invention is applied. The front and rear surfaces of the digital camera are presented in the upper and lower parts, respectively, of FIG. 22. The digital camera includes an image pickup lens, a light-emitting unit 15 serving as a flash, a display unit 16, a control switch, a menu switch, and a shutter 19. The digital camera of FIG. 22 is realized by using a display apparatus according to an embodiment of the present invention as the display unit 16.

Figure 23:
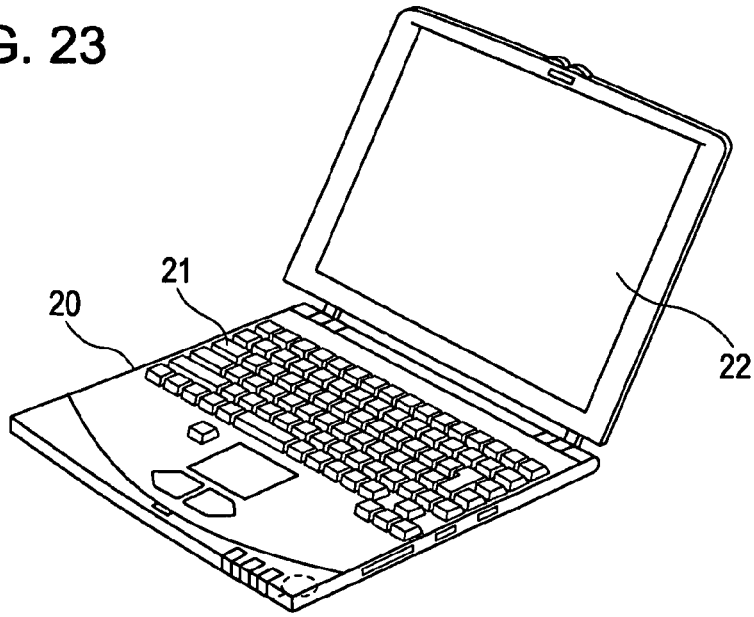
FIG. 23 is a perspective view of a notebook personal computer including a display apparatus according to an embodiment of the present invention.

FIG. 23 illustrates a notebook personal computer to which the present invention is applied. A main body 20 of the notebook personal computer includes a keyboard 21 for entering characters and the like. A cover for the main body 20 includes a display unit 22 for displaying images. The notebook personal computer of FIG. 23 is realized by using a display apparatus according to an embodiment of the present invention as the display unit 22.

Figure 24:
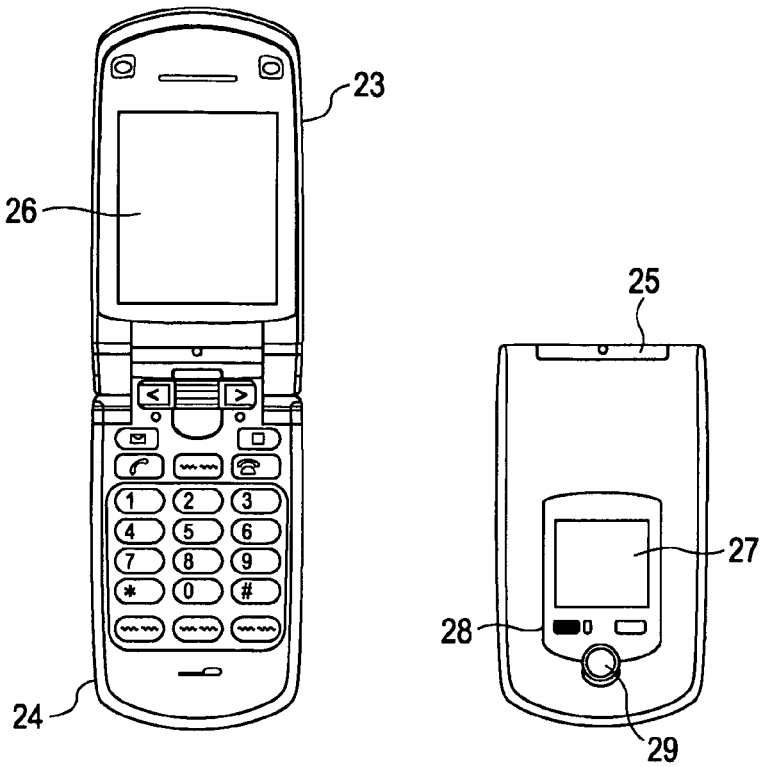
FIG. 24 illustrates a mobile terminal including a display apparatus according to an embodiment of the present invention.

FIG. 24 illustrates a mobile terminal to which the present invention is applied. An open state and a folded state of the mobile terminal are presented in the left and right parts, respectively, of FIG. 24. The mobile terminal includes an upper housing 23, a lower housing 24, a joint (hinge) 25, a display 26, a sub-display 27, a picture light 28, and a camera 29. The mobile terminal of FIG. 24 is realized by using a display apparatus according to an embodiment of the present invention as the display 26 and/or the sub-display 27.

Figure 25:
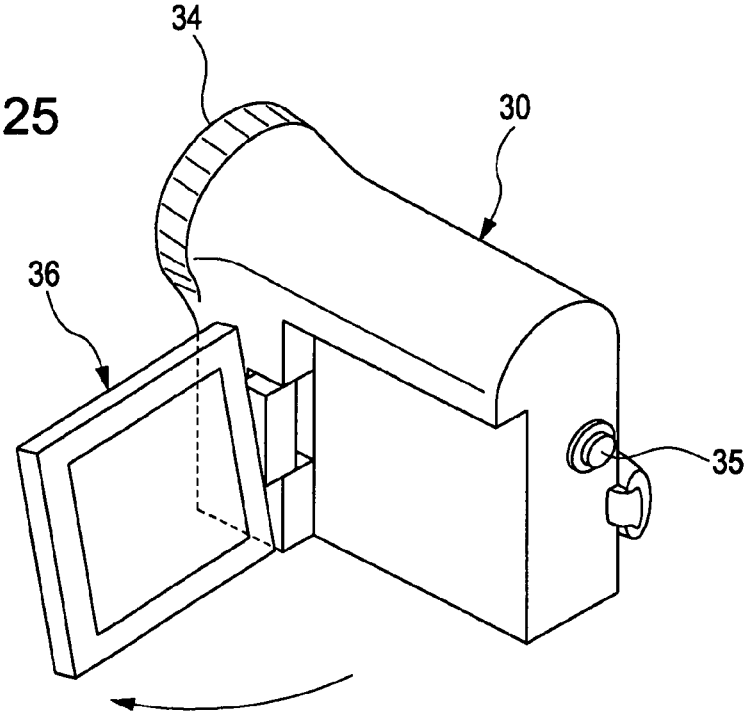
FIG. 25 is a perspective view of a video camcorder including a display apparatus according to an embodiment of the present invention.

FIG. 25 illustrates a video camcorder to which the present invention is applied. The video camcorder includes a main body 30, a lens 34 provided on the front side of the main body 30 and used for shooting a subject, a start/stop switch 35 for starting or stopping the shooting operation, and a monitor 36. The video camcorder of FIG. 25 is realized by using a display apparatus according to an embodiment of the present invention as the monitor 36.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus comprising:

a substrate having wiring lines including at least signal lines arranged in columns, scanning lines arranged in rows, and predetermined power supply lines; and a matrix of pixels, each pixel being disposed at an intersection between a signal line and a scanning line, wherein the wiring lines are formed by patterning a conductor film;

each pixel includes active devices and a light-emitting device connected to the wiring lines, operates in response to a control signal supplied from a scanning line, and causes a drive current supplied from a power supply line to flow through the light-emitting device according to a video signal supplied from a signal line;

the pixel has an outer region extending linearly along a boundary with an adjacent pixel and an inner region extending along the inner side of the outer region;

the wiring lines are arranged across the outer region and the inner region;

an outer uneven zone is formed along the outer region and on the substrate due to level differences resulting from the presence of the wiring lines;

an inner uneven zone is formed along the inner region and on the substrate also due to level differences resulting from the presence of the wiring lines; and a pattern of the conductor film of which the wiring lines are made is formed properly such that recessed portions of the outer uneven zone are located directly behind their corresponding raised portions of the inner uneven zone, as viewed from inside the pixel.

2. The display apparatus according to claim 1, wherein the conductor film includes an upper layer and a lower layer;

the wiring lines include upper layer lines formed by patterning the upper layer and lower layer lines formed by patterning the lower layer; and a pattern of the lower layer is formed properly such that the recessed portions of the outer uneven zone are located directly behind their corresponding raised portions of the inner uneven zone, as viewed from inside the pixel.

3. The display apparatus according to claim 1, wherein the pattern of the conductor film is electrically connected to the wiring lines and constitutes part of the wiring lines.

4. The display apparatus according to claim 1, wherein the pattern of the conductor film includes pads that are electrically isolated from the wiring lines and compensate for level differences resulting from the presence of the wiring lines.

5. A method for making a display apparatus including a substrate having wiring lines including at least signal lines arranged in columns, scanning lines arranged in rows, and predetermined power supply lines; and a matrix of pixels, each pixel being disposed at an intersection between a signal line and a scanning line; wherein the wiring lines are formed by patterning a conductor film; and each pixel includes active devices and a light-emitting device connected to the wiring lines, operates in response to a control signal supplied from a scanning line, and causes a drive current supplied from a power supply line to flow through the light-emitting device according to a video signal supplied from a signal line;

the method for making the display apparatus, comprising the steps of:

arranging the wiring lines across an outer region and an inner region of the pixel, the outer region extending linearly along a boundary with an adjacent pixel, the inner region extending along the inner side of the outer region;

forming properly a pattern of the conductor film of which the wiring lines are made such that recessed portions of an outer uneven zone are located directly behind their corresponding raised portions of an inner uneven zone as viewed from inside the pixel, the outer uneven zone being formed along the outer region and on the substrate due to level differences resulting from the presence of the wiring lines, the inner uneven zone being formed along the inner region and on the substrate also due to level differences resulting from the presence of the wiring lines;

forming, along the outer uneven zone and the inner uneven zone, partition walls surrounding the inside area of the pixel;

preparing a working base on which films of light-emitting materials that emit light of different colors are deposited at positions corresponding to the respective pixels;

placing the working base opposite the substrate, with the working base being in contact with the top of the partition walls; and evaporating the films of light-emitting materials that emit light of different colors onto the respective inside areas of the corresponding pixels, with the inside area of each pixel being surrounded by the partition walls, so as to form a light-emitting layer of the light-emitting device in each pixel.

* * * * *